US009719313B2

(12) United States Patent
Mission et al.

(10) Patent No.: US 9,719,313 B2
(45) Date of Patent: Aug. 1, 2017

(54) SYSTEM FOR HANDLING RISER PIPE

(71) Applicants: NAVALIMPIANTI S.P.A., Monfalcone (IT); FINCANTIERI S.P.A., Trieste (IT)

(72) Inventors: Angelo Mission, Monfalcone (IT); Luca Ambrosio, Trieste (IT)

(73) Assignees: NAVALIMPIANTI S.P.A., Monfalcone (GO) (IT); FINCANTIERI S.P.A., Trieste (UD) (IT)

( * ) Notice: Subject to any disclaimer, the term of this patent is extended or adjusted under 35 U.S.C. 154(b) by 0 days.

(21) Appl. No.: 14/904,835

(22) PCT Filed: Mar. 11, 2014

(86) PCT No.: PCT/EP2014/000633
§ 371 (c)(1),
(2) Date: Jan. 13, 2016

(87) PCT Pub. No.: WO2014/146759
PCT Pub. Date: Sep. 25, 2014

(65) Prior Publication Data

US 2016/0168930 A1 Jun. 16, 2016

(30) Foreign Application Priority Data

Mar. 20, 2013 (IT) ..... UD2013A0038

(51) Int. Cl.
*E21B 19/14* (2006.01)
*E21B 17/01* (2006.01)
*B63B 35/03* (2006.01)

(52) U.S. Cl.
CPC ..... *E21B 19/143* (2013.01); *B63B 35/03* (2013.01); *E21B 17/01* (2013.01)

(58) Field of Classification Search
CPC ..... E21B 17/01; E21B 19/143; B63B 35/03
USPC ..... 414/22.51, 22.52, 22.53, 22.54, 22.55, 414/22.56, 22.57, 22.58, 22.59, 22.61, 414/22.62, 22.63, 22.64, 22.65, 22.66, 414/22.67, 22.68, 22.69, 22.71, 745.1, 414/745.2, 745.4, 745.7, 749.9
See application file for complete search history.

(56) References Cited

U.S. PATENT DOCUMENTS 3,870,165 A * 3/1975 Besijn ..... E21B 19/14 211/70.4
3,939,990 A * 2/1976 Johnson ..... E21B 19/143 114/265
4,202,653 A * 5/1980 Moller ..... B65G 1/0442 414/22.57
4,621,974 A * 11/1986 Krueger ..... E21B 19/20 211/70.4
4,692,081 A 9/1987 Bennett
4,744,716 A * 5/1988 Pasko ..... B65G 47/1407 414/376

(Continued)

OTHER PUBLICATIONS

International Search Report for corresponding International Application No. PCT/EP2014/000633.

*Primary Examiner* — Charles A Fox
*Assistant Examiner* — Joseph J Sadlon
(74) *Attorney, Agent, or Firm* — Egbert Law Offices, PLLC

(57) ABSTRACT

System for handling riser pipe on an offshore vessel comprising a lifting device for lifting the pipe from a storage zone onto the deck.

36 Claims, 24 Drawing Sheets

(56) References Cited

U.S. PATENT DOCUMENTS

| | | | | |
|---|---|---|---|---|
| 5,183,122 | A * | 2/1993 | Rowbotham | E21B 19/14 175/52 |
| 6,352,388 | B1 * | 3/2002 | Seguin | B63B 35/03 405/166 |
| 8,113,762 | B2 * | 2/2012 | Belik | E21B 19/15 414/22.62 |
| 8,291,845 | B2 * | 10/2012 | Wijning | B63B 35/4413 114/72 |
| 2005/0036879 | A1 * | 2/2005 | Jhaveri | B25J 9/0084 414/751.1 |
| 2007/0114113 | A1 | 5/2007 | Muse et al. | |
| 2008/0101891 | A1 | 5/2008 | Belik | |
| 2009/0238663 | A1 * | 9/2009 | Littlely | E21B 19/155 414/22.54 |
| 2011/0097156 | A1 * | 4/2011 | Pose | B63B 35/03 405/166 |

* cited by examiner

VIEW D

Part, A

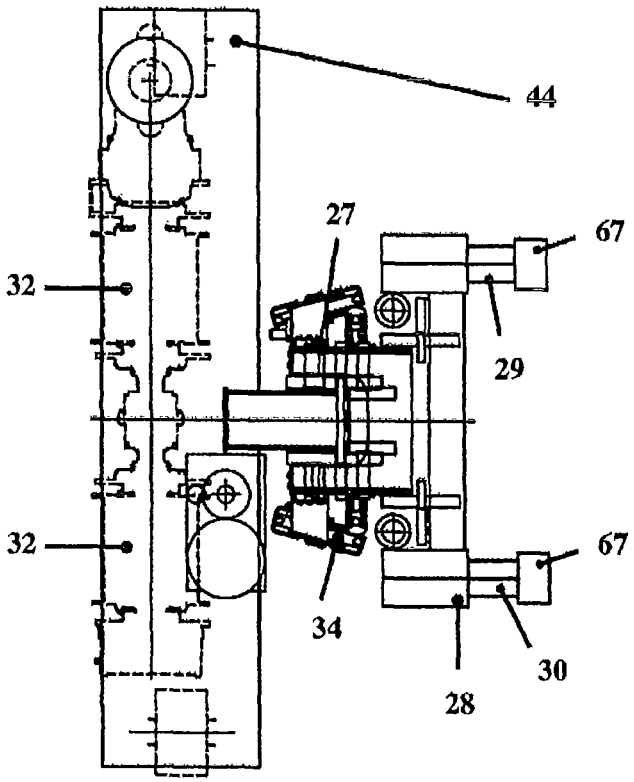
Fig. 13
Fig. 14
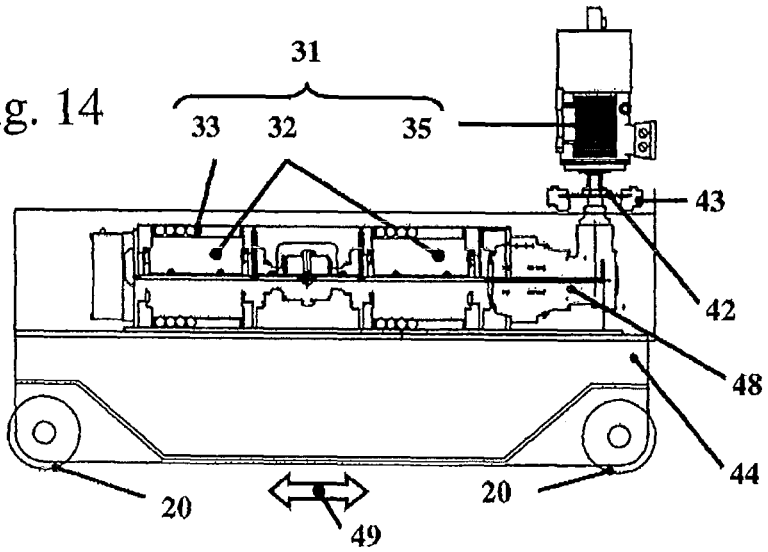

DETAIL B

DETAIL C

SYSTEM FOR HANDLING RISER PIPE

TECHNICAL FIELD

The present invention relates to a movement system for tubular elements on a vessel according to the characteristics of the pre-characterizing part of claim 1.

The present invention also relates to vessels according to the characteristics of claims 36 to 38.

DEFINITIONS

In the present description and in the appended claims the following terms must be understood according to the definitions given in the following.

In the present description and in the appended claims by the general expression "vessels" one will indicate ships, boats, rigs, floating structures in general and in particular drillships, semisubmersible drilling rigs.

In the present description and in the appended claims by the general expression "tubular elements" one will indicate both real pipes suitable to be laid on the sea or ocean bed by means of pipe-laying vessels, or the so-called "risers" which are tubular elements suitable to be reciprocally fastened after one another to form the drilling duct between the vessel and the sea bed and in the underwater drilling wells.

PRIOR ART

In the field of the production of vessels suitable for oil drilling, an essential role is played by the vertical duct that connects the vessel to the sea bed, in correspondence with which the drilling of the well occurs. Said vertical duct is made up of elements called "risers" which are tubular elements that form a vertical or catenary duct of connection between a control valve placed on the sea bed usually called BOP [Blow Out Preventer] and the vessel. The risers are normally flanged tubular elements made up of a main hole and a number of auxiliary lines for the passage of the control fluids, in addition to pushing floating elements inserted around the structure of the riser itself. For example, the auxiliary lines can comprise a line for the inlet of sludge (kill line), a line for the recovery of sludge (choke line), two lines relating to the control of the control valve, a pumping line (booster line).

The present invention in general relates to the movement of tubular elements from a storage zone present on the vessel and handling means of the tubular elements. The present invention, in particular, relates to the movement of risers from a storage zone present on the vessel towards the derrick. However, it will be evident that the present invention is not limited to the single specific application of the risers but, in general, it is applicable to the movement of generic tubular elements such as in the case of pipe-laying ships.

The length of the risers or of the tubular elements can be in the range of 22-27 meters and the diameter of the main hole can be in the range of 530-540 mm but it will be evident in view of the present description that the invention is applicable to tubular elements in general, independently of the sizes indicated. In the case of the risers there are also further elements called "pushing modules" having the function of reducing the weight in water of the single riser. The weight of the risers can be in the range of 20-40 tons. The risers are connected to one another according to various coupling modes that are considered known for the purpose of the present invention.

Each "riser" is a delicate element that must be moved appropriately. It is necessary to be particularly careful in the phase of taking out from the storage zone, typically a parking zone on the deck of the vessel or a hold. Furthermore, the movement phase on the deck of the vessel for the purpose of taking the riser towards the derrick in order to connect it to the vertical duct of already positioned risers is very delicate as well. The risers, once connected to one another to form the vertical duct, form the connection between the probe plane of the vessel and the control valve placed on the sea bed usually indicated by the term "Blow Out Preventer". During the drilling activities, the drilling rods are lowered into the riser. To carry out the drilling activity some drilling fluids are used, which are pressure-pumped into the drilling rods that are hollow. Normally, the drilling fluids are made up of drilling sludge, specially prepared with the addition of various additives to modify its physical properties. The drilling sludge, pumped through the rods, comes out of the drilling head to go back up towards the surface where it is treated to be recycled and pumped into the well again. During the rise, once the control valve placed on the sea bed has been reached, the sludge goes back towards the drilling means passing through the air space between the main hole of the riser and the drilling rods lowered into it. This is, in fact, the main function of the risers, that is to say, creating an "airtight" passage for the rise of the drilling sludge from the sea bed to the drilling means.

The tubular elements or risers are usually stored in a covered hold or on the deck of the vessel.

In the prior art solutions in which the tubular elements or risers are stored in a covered hold, the movement of the tubular elements occurs by means of bridge cranes that take out the tubular elements from storage stacks to take them towards a movement device which in its turn takes them towards the deck of the vessel.

In the prior art solutions in which the tubular elements or risers are stored on the deck of the vessel a first movement phase occurs by means of bridge cranes or movement cranes.

Once the phase of taking out the risers has been completed, they must be moved for the purpose of laying them onto a transfer device usually known by the name of "catwalk" which is a trolley that allows to transfer the riser into the derrick where each tubular element or riser is driven from an essentially horizontal condition to an essentially vertical condition to connect it to the series of previously installed risers to form the vertical duct up to the sea or ocean bed where the well closed by the respective control valve is dug.

For example a vessel for oil drilling must be able to operate at great depths on sea or ocean beds, where by "great depths" one means, without limits for the purpose of the present invention, sea or ocean depths in the range of 3000-4000 meters. For example for a depth of about 3700 meters with risers having a length of 27.5 meters it will be necessary to move about 135 risers both in the laying phase of the risers themselves and in the recovery phase from the well towards the storage zone.

For example some of the prior art solutions, such as the solution described in WO 2010/000745, provide the storage of tubular elements according to a storage configuration in which the tubular elements are vertically stored within a hold, in the sense that the longitudinal development axis of the tubular element is placed vertically within the hold. Such solutions, besides necessarily requiring the resort to lifting cranes with the previously described problems concerning the risks and dangers of management of suspended loads, also require the bottom of the hold to be modified for mounting base supports of the risers, which base supports will have to be replaced for example in the case in which one wants to operate with different risers. Furthermore, in these solutions the extraction of the riser from the hold, being the riser placed vertically, requires it to be lifted for its entire longitudinal extension over the deck of the vessel so that the lower end of the riser completely comes out of the hold. This operation is considerably dangerous if one considers the length of the risers (even up to nearly 30 meters) and their weight (in the range of 20-40 tons) in addition to the fact that they must be lifted by means of a deck crane onto a vessel deep at sea.

Other prior art solutions provide the storage of the risers within a hold of the vessel according to an arrangement in which the longitudinal axis of lengthwise development of the riser or of the tubular element is placed essentially horizontally. In these solutions, however, the movement from inside the hold towards the deck occurs by means of bridge cranes internal to the hold that take up considerable useful space inside the hold itself that may be used for the storage of other risers. In fact, the bridge cranes mounted internally take up much space in height and also in length and width because they must be able to move along the entire volume of the hold. Furthermore there are the previously described problems concerning the risks and dangers of management of suspended loads. In other solutions of this type the hold is essentially free from bridge cranes but a bridge crane is used mounted on the upper part and externally to the hold, that is to say, on the deck of the vessel. In these solutions, however, the hold must be necessarily provided with considerably wide ports that may ensure the access of the external bridge crane to the various zones of the hold for the taking out and the movement of the risers. This solution in addition to the need for huge hold ports is also subjected to the previously described problems concerning the risks and dangers of management of suspended loads. Furthermore, having huge ports of access to the hold for allowing access by means of the bridge crane external to the hold, the content of the hold and also the operators being exposed to the weather.

Problems of the Prior Art

The prior art solutions concerning the movement and the transfer of the tubular elements from the storage zone up to the transfer device that transfers them to the derrick have various problems.

First of all in the prior art solutions in which the tubular elements or risers are stored in a covered hold and the movement of the tubular elements occurs by means of bridge cranes there are both safety problems concerning the movement of loads suspended over a vessel and efficiency problems in the exploitation of the space available in the hold of the vessel. In fact, the bridge crane arranged inside the hold occupies a great space for the entire length of the hold itself and this space, intended for the movement of the bridge crane over the stacks of tubular elements, is actually unused space for storage.

Furthermore, the movement of the tubular elements, which are very heavy, by means of bridge cranes and with suspension cables or rigid elements, exposes the tubular elements to impacts that may compromise their tightness or coupling.

Moreover, the movement process is managed manually by the operators who control the bridge crane or the transfer cranes, without the use of automated procedures. Moreover, the presence of the operators in the control zones exposes the operators themselves to conditions of possible danger.

Furthermore, the poor automation of the process is often a serious problem in the phases of the operators' shift change. In fact when, after about six months, the operators are replaced by a new crew, a reduction in the crew's performance occurs with a consequent slowdown in the operations of laying of the tubular elements.

Furthermore, the prior art solutions make the phases of inspection of the tubular elements prior to their taking out difficult.

The prior art solutions, moreover, by providing the assembly of a bridge crane within the hold of the ship, necessarily require the installation of the bridge crane to occur during the process of construction of the ship because it must be mounted inside the hold before the hold itself is closed on its upper part by the respective closing vault that constitutes the deck of the ship. Before the hold is definitively closed the bridge crane remains exposed to the weather and damage that may compromise its functionality before the launch of the ship.

Above all, as far as the risers are concerned, it is also necessary to consider that in the storage zone there are risers of different types according to the depth at which each riser will operate. Therefore, it is essential that, both in the operations of loading of the risers onto the ship and in the phase of their unloading for their use, the operator follows the correct order of loading and taking out to prevent a riser suitable to operate at shallow depths from being taken to be installed at great depths. At present the selection of the risers to be taken as well as their loading operations are carried out by the operators manually, exposing the procedure to errors that may have serious consequences from the environmental point of view or, in any case, slowdowns in the operations of taking out or loading of the risers.

Further drawbacks of the prior art solutions derive from the fact that all the devices involved in the movement of the tubular elements are often considered separately starting from the ship design phase, but also in the phase of fitting out of the ship and even in the phase of use of the devices themselves. Actually, an integration of the various systems into one single movement system is absent, which allows for the guided, safe and reliable movement of the tubular elements along their movement path from the storage zone up to the machine that carries out the laying, both as far as tubular elements in the form of risers for drilling are concerned, and as to tubular elements in the form of pipes that are laid on the sea bed by a vessel in the form of a pipe-layer.

The movement activities of the tubular elements, particularly in the case of the risers, are often made complex due to the number of necessary operations and to the number of various machines involved, which are not coordinated or integrated with one another and which must be necessarily managed manually by single operators with all the risks connected to errors of movement, fall of suspended loads, impacts, damage, etc.

As previously observed, the risers are not all identical but can differ from each other depending on the depth at which they are suitable to operate. As a consequence, a drawback of the prior art systems is that the loading and the taking out of the risers generally occurs manually by the operators who establish the order of loading. An error by those who are in charge of the loading may cause following delays in the laying phase for example in the case in which a riser suitable to operate at great depths (that must be taken before the others) has been loaded on a bottom rack and below with respect to a series of risers suitable to operate at shallow depths (that must be the last to be taken). Furthermore, if the operators in charge of the laying do not notice the error, they might lay at great depths a riser that is not suitable to operate at such depths with the risk of breaks that may cause irreparable environmental damage and compromise the operators' safety.

Aim of the Invention

The aim of the present invention is to provide an improved movement device and method for the movement of tubular elements from the hold of the vessel to the deck of the vessel itself.

A further aim of the present invention is to provide an improved lifting device and method for the movement of tubular elements on the deck of the vessel for the purpose of taking the tubular elements to the transfer device that transfers them to the derrick.

Concept of the Invention

The aim is achieved with the characteristics of the main claim. The sub-claims represent advantageous solutions.

Advantageous Effects of the Invention

The solution according to the present invention, by the considerable creative contribution the effect of which constitutes an immediate and important technical progress, presents various advantages.

Advantageously, the solution according to the present invention allows to best use the space available inside the hold where the tubular elements are stored obtaining definitely more favourable coefficients of filling of the hold with respect to the prior art solutions. In this way it is possible either to load a greater number of tubular elements onto the same vessel or to design smaller-sized vessels with an equal number of tubular elements that one can load, with consequent economic benefits both in the phase of construction of the vessel and during the operation of the latter.

In general the solution according to the present invention allows to eliminate the traditional lifting members, normally made up of bridge cranes, hold elevators and deck cranes, replacing them with more effective and safer devices able to ensure the movement of the tubular elements or risers in conditions of maximum safety. Furthermore, it allows for a high degree of automation of the process of movement of the tubular elements. Moreover, the number of transfers of the tubular elements or risers between different types of machines is minimized.

With reference to the movement device of the invention that realizes the movement of the tubular elements or risers within the hold of a vessel, the solution according to the present invention allows to solve the safety problems related to the presence of suspended loads because the solution according to the present invention allows to obtain a movement of the tubular elements in a locking condition on the driving means, eliminating all the conditions of presence of suspended loads. This is further advantageous because impacts are prevented, which may damage the tubular elements. Further advantageously the solution according to the present invention also allows to completely automate the transfer phase as well as the hold loading phase, so that the operators no longer have to handle the driving means manually, reducing the possibilities of error and reducing the exposure of the operators to conditions of danger. Furthermore, the solution according to the present invention also allows to maintain high standards of operative efficiency also in the case of changes of the crew or of the operators. Furthermore, the solution according to the present invention facilitates the phases of inspection of the tubular elements prior to their taking out from the storage stacks and also allows to know with precision and automatically the position of the various types of tubular elements or risers present in the storage stacks. Moreover, the solution according to the present invention allows for the assembly of the movement devices for tubular elements also on existing ships and, anyway, after the launch of the ship itself, preventing the movement devices from remaining exposed to the weather for long periods of time.

With reference to the lifting device of the invention that realizes the movement of the tubular elements or risers in correspondence with the deck of the vessel, the solution according to the present invention allows to carry out the movement of the tubular elements or risers on the deck without having to use the on-board cranes and, therefore, completely eliminating the suspended loads, to the advantage of the personnel's safety and of the preservation of the riser from possible damage. This is further advantageous as impacts are prevented, which may damage the tubular elements. Furthermore it advantageously allows for an efficient transfer of the tubular elements or risers between the taking out position within the hold or on the deck and the unload position towards the transfer device with one single operation in a constant condition of locking of the tubular element or riser.

Advantageously the solution according to the present invention allows to obtain a movement system for tubular elements that is able to manage in an automatic way the entire movement of the tubular elements themselves both in the loading phase of the tubular elements within the storage zone and during the laying phase of the tubular elements. The system according to the present invention also allows to have one single subject supplying the entire management and movement chain of the tubular elements, to the advantage of the reciprocal integration of the various constituents of the system and to the advantage of an efficient and safe movement of the tubular elements themselves.

Advantageously the solution according to the present invention can be installed on the vessel also once the construction of the latter has been almost completed, thus preventing the equipment and the devices of the movement system from having to be installed in the phase of construction of the vessel, exposing them to the weather and to tough environmental conditions that may compromise their efficiency and functionality. Furthermore, it allows for a high degree of integration with the phase of design of the vessel, which already in the design phase can be pre-arranged to house the system according to the present invention allowing, with an equal capacity of tubular elements carried, to optimize and therefore to reduce the size of the area destined to their storage and therefore of the vessel itself, or, with equal sizes of the vessel, to increase the area intended for their storage.

Further advantageously the system according to the present invention allows for an easy and fast inspection of the tubular elements also when these are stored within the storage zone, which advantageously allows to carry out their inspection during the navigation phase. Therefore, it is possible to save time during the operations of installation of the tubular elements themselves, or rather preliminarily and beforehand highlighting any possible problems in such a way as to allow to prearrange appropriate actions of correction of the procedure of taking out of the tubular elements from the storage zone keeping into account any possible anomalies evidenced in the preliminary inspection phase.

DESCRIPTION OF THE DRAWINGS

In the following a solution is described with reference to the included drawings to be considered as a non-exhaustive example of the present invention in which:

FIG. 13 schematically represents a plan view of a supporting base of the movement device for tubular elements made in accordance with the present invention.

FIG. 14 schematically represents a side view of the supporting base of the movement device for tubular elements made in accordance with the present invention.

DESCRIPTION OF THE INVENTION

Figure 1:
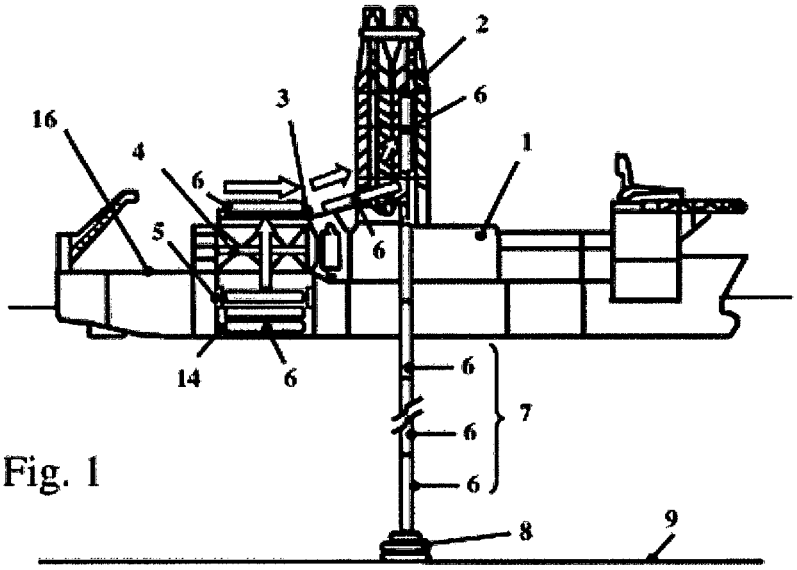
FIG. 1 represents a schematic side view of a drillship made in accordance with the present invention.
Figure 2:
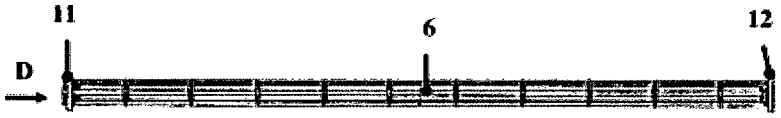
FIG. 2 represents a schematic plan view of a tubular element in the form of a riser.
Figure 3:
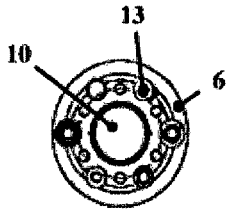
FIG. 3 represents a schematic view of the riser of FIG. 2 according to the point of view indicated by "D" in FIG. 2.
Figure 4:
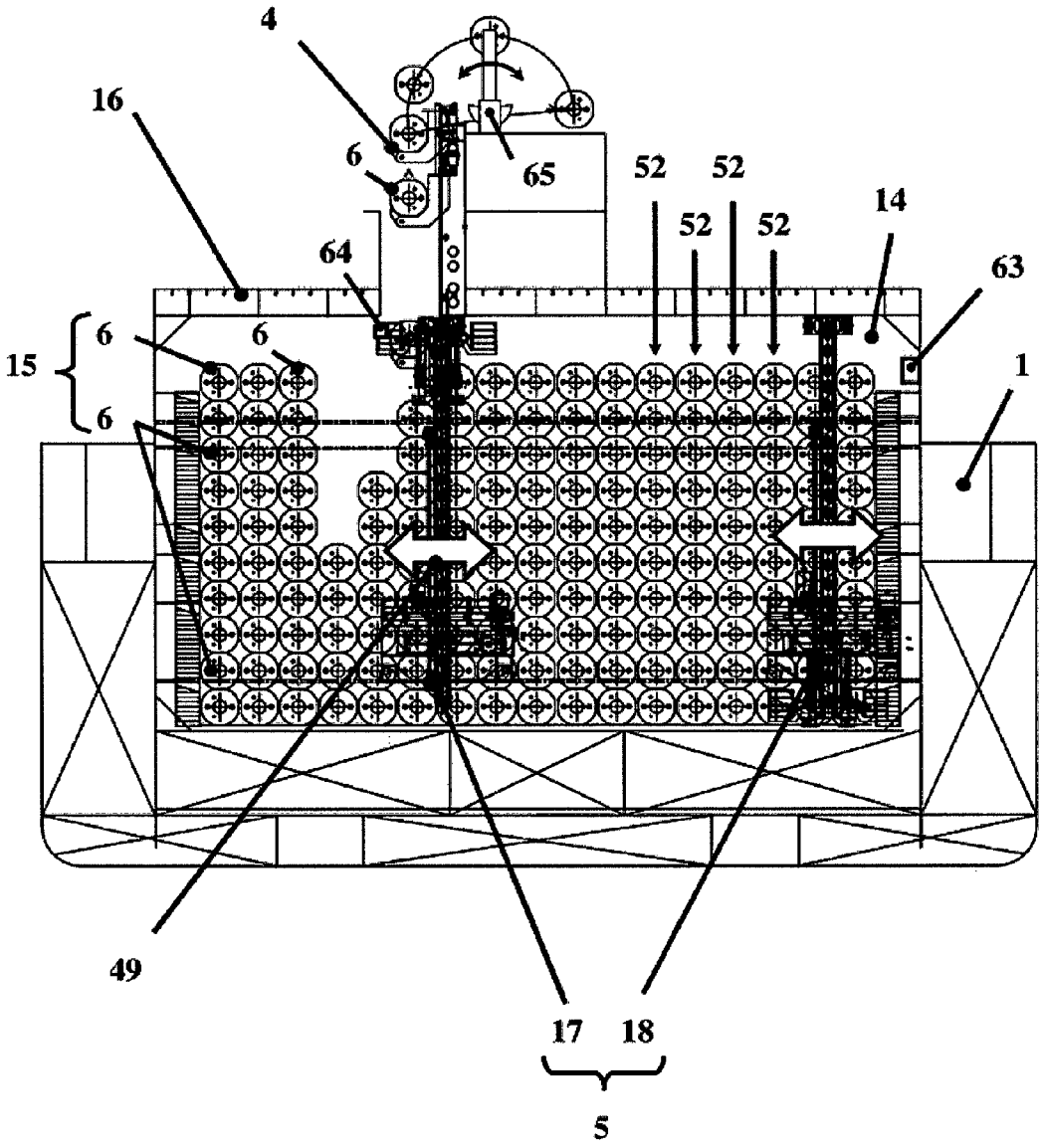
FIG. 4 schematically represents a sectional view of a vessel made in accordance with the present invention.
Figure 5:
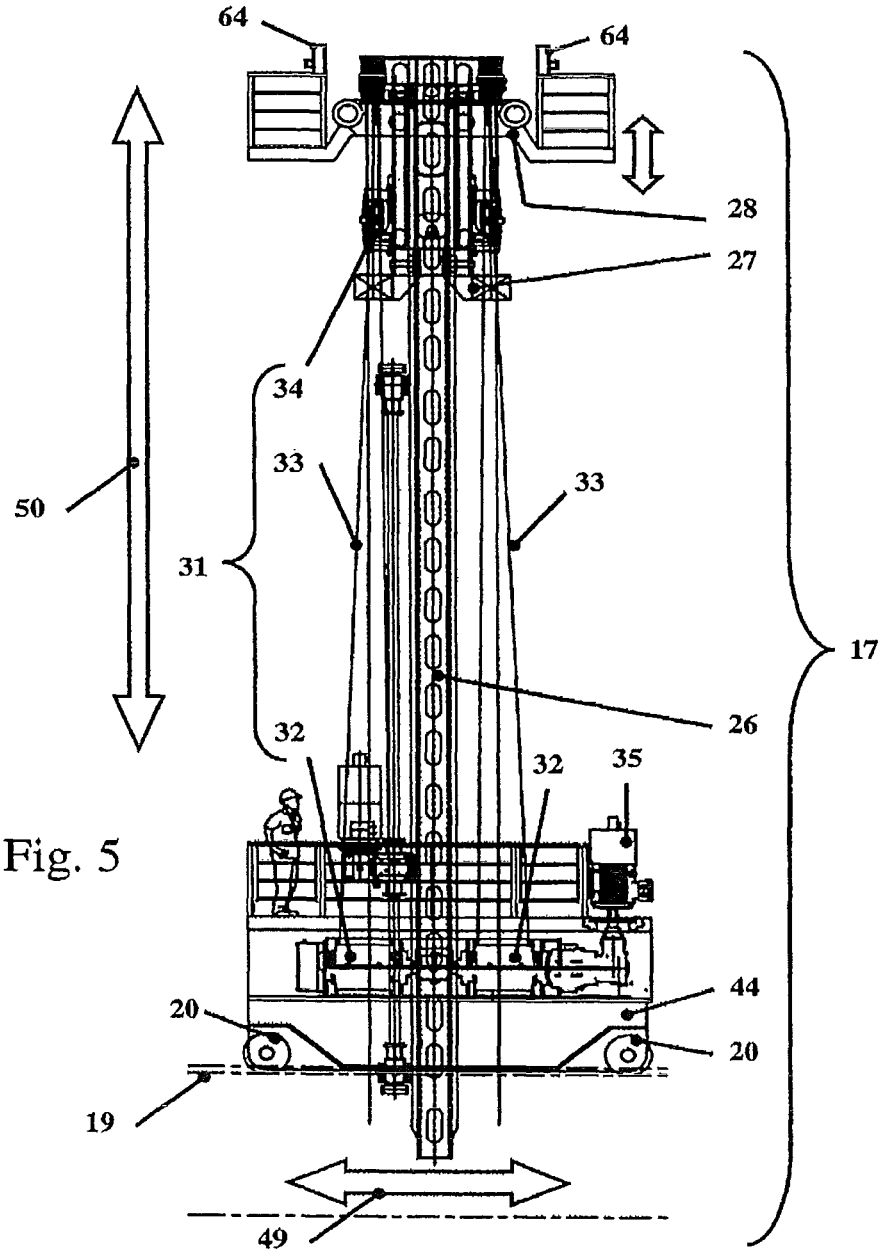
FIG. 5 schematically represents a side view of a movement device for tubular elements made in accordance with the present invention.
Figure 6:
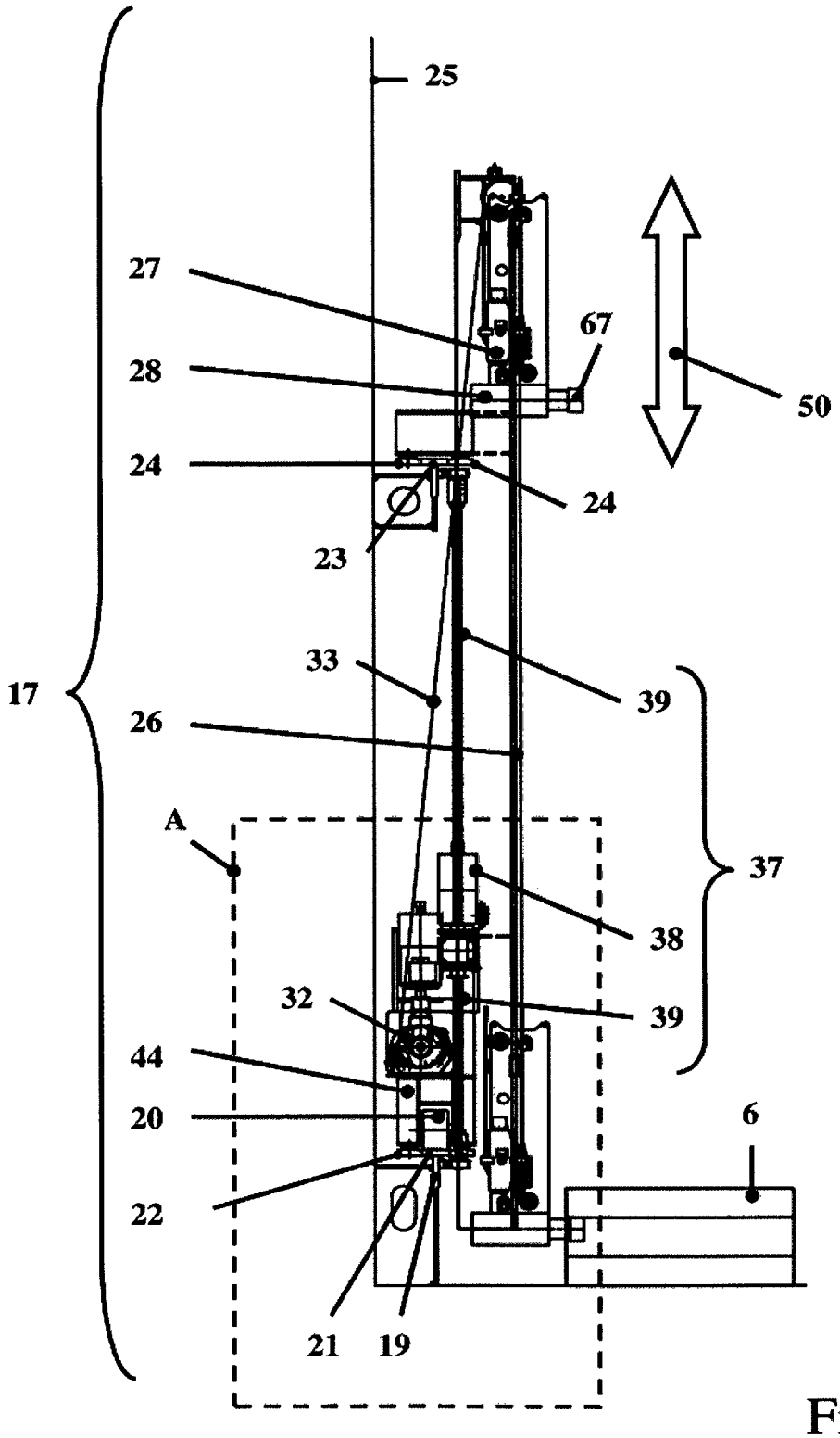
FIGS. 6A and 6B schematically represent front views of a movement device for tubular elements made in accordance with the present invention in two different positioning configurations of the movement cursor.
Figure 7:
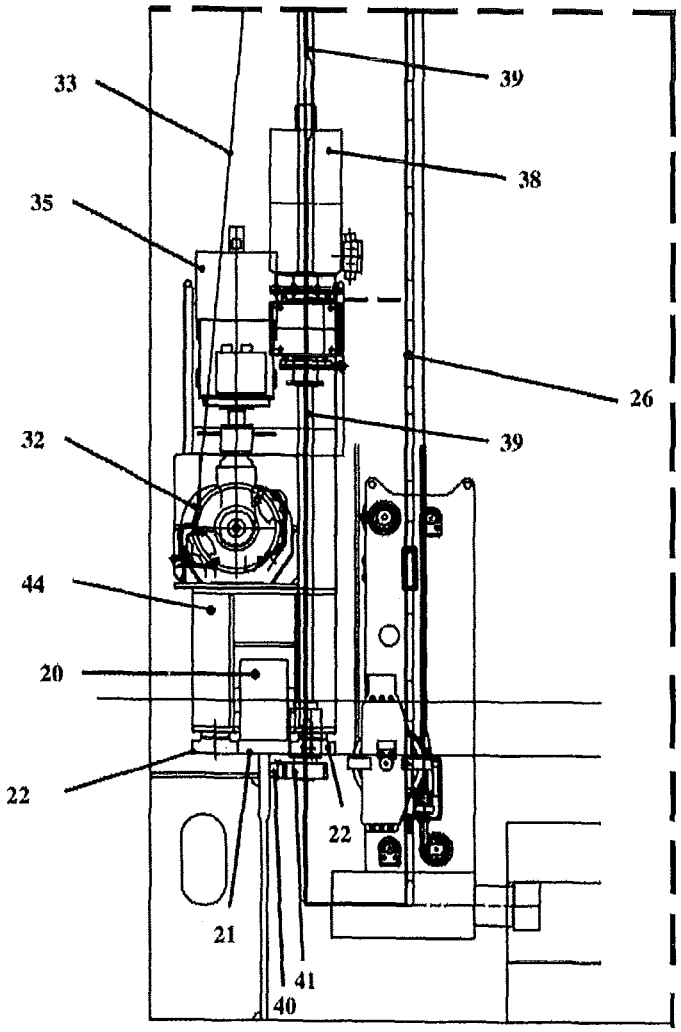
FIG. 7 schematically represents an enlarged view of the detail indicated by "A" in FIG. 6 relatively to the movement device for tubular elements made in accordance with the present invention.
Figure 8:
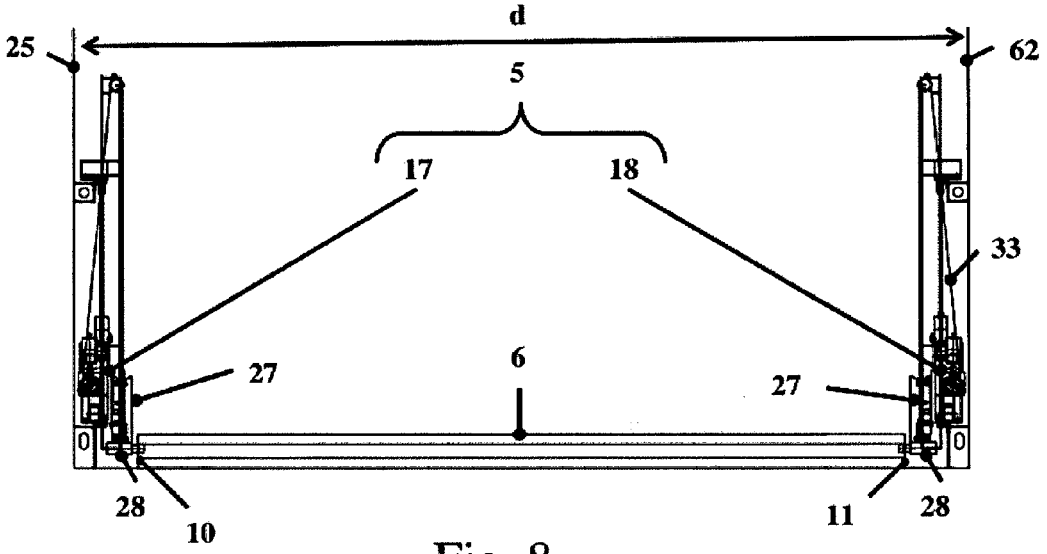
FIG. 8 schematically represents a front view of the movement device for tubular elements made in accordance with the present invention in a first movement condition.
Figure 9:
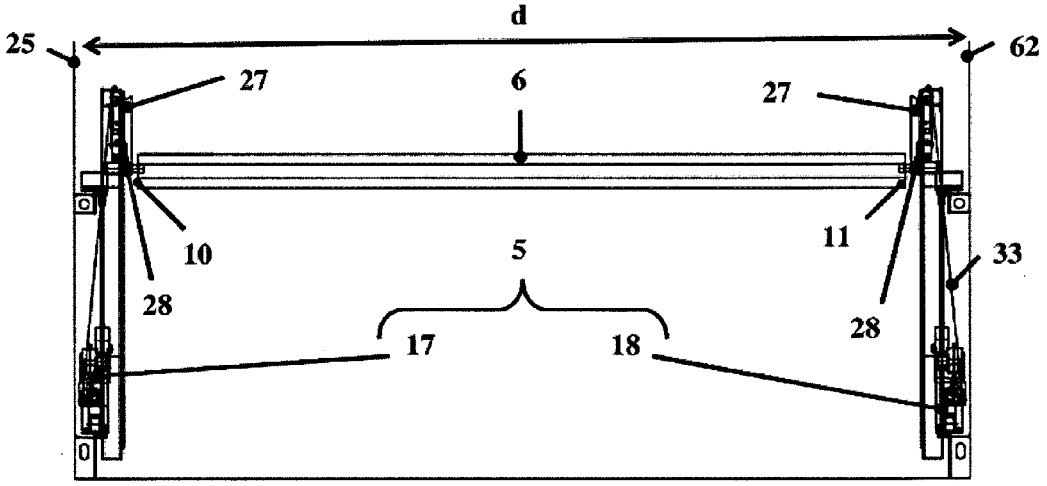
FIG. 9 schematically represents a front view of the movement device of FIG. 8 in a second movement condition.
Figure 10:
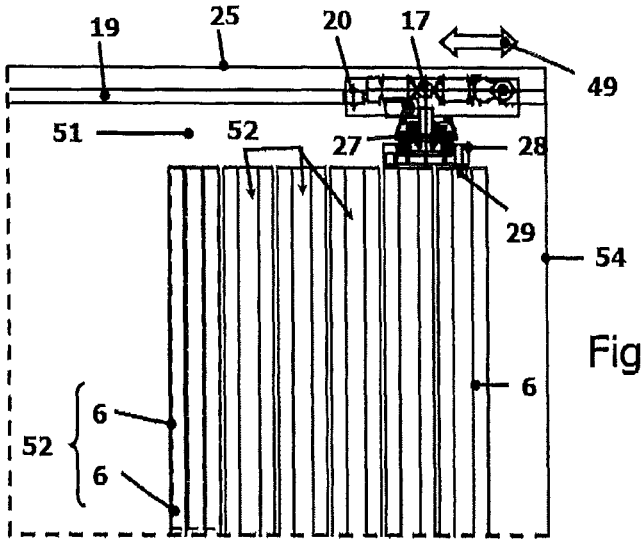
FIG. 10 schematically represents a plan view of the movement device made in accordance with the present invention in a third movement condition.
Figure 11:
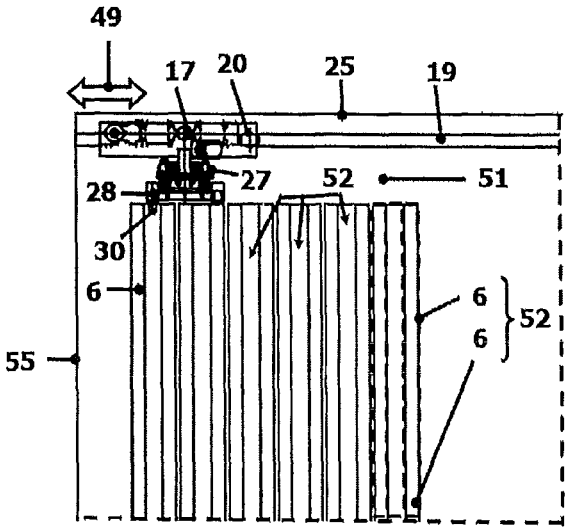
FIG. 11 schematically represents a plan view of the movement device made in accordance with the present invention in a fourth movement condition.
Figure 12A:
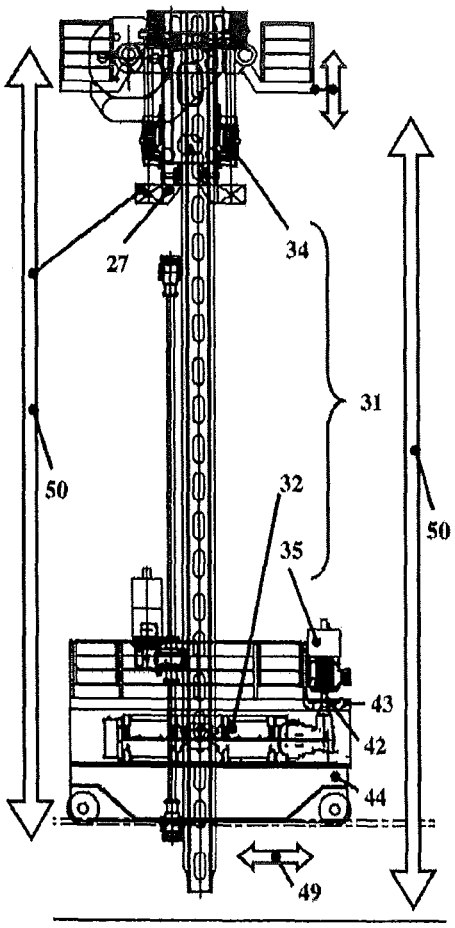
FIGS. 12A and 12B schematically represent side views of the movement device for tubular elements made in accordance with the present invention in two different positioning configurations of the movement cursor.
Figure 12B:
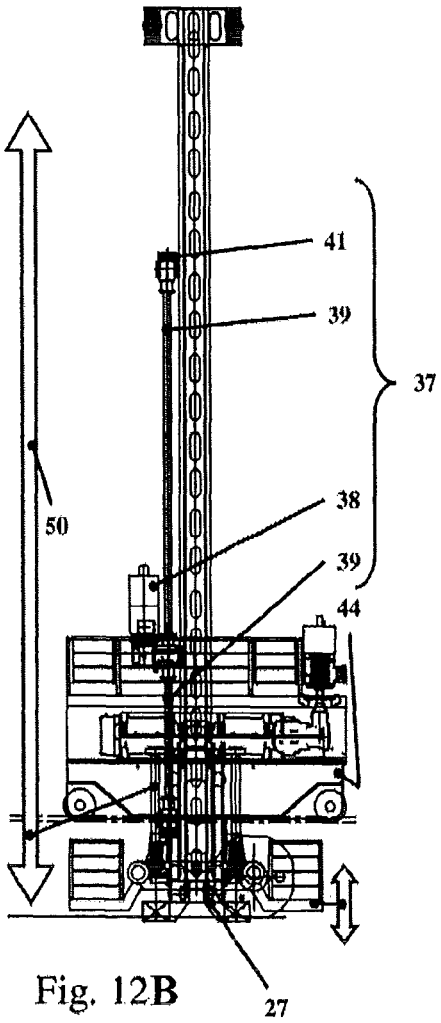

With reference to the figures (FIG. 1) the present invention finds application in the movement of tubular elements (6) from a storage zone (14) of a vessel (1) towards at least one laying or use zone (2) of the tubular elements. For example, without limitation for the purpose of the present invention, in the case of a drillship or in the case of a semisubmersible drilling rig, the tubular elements will be risers that are taken from a storage zone (14) that can be a hold or a deposition zone on the deck. The risers (6) are (FIG. 2, FIG. 3) normally tubular elements flanged in correspondence with a first end (11) and in correspondence with a second end (12) that are opposite ends with respect to the longitudinal development of the tubular element in the form of a riser. The riser (FIG. 3) includes a main hole (10) and a number of auxiliary lines (13) for the passage of the control fluids, as well as floating pushing elements inserted around the structure of the riser itself. Once the taking out phase of one of the risers has been completed, it must be moved for the purpose of laying it onto a transfer device (3) usually known by the name of "catwalk" which is a trolley that allows to transfer the risers inside (FIG. 1) the derrick (2) where each tubular element or riser is taken from an essentially horizontal condition to an essentially vertical condition to connect it to the series of risers previously installed to form the vertical duct (7) up to the sea or ocean bed (9) where the well closed by the respective control valve (8) is dug.

Although in the following of the present description explicit reference will be made to the solution relating to the application of the present invention to drillships or semisubmersible drilling rigs and, therefore, explicit reference will be made to the movement of risers, it will be evident that the present invention is generally applicable to the field of vessels (1) in which it is necessary to carry out the movement of tubular elements (6) from a storage zone (14) to a laying or use zone (2).

As previously explained the tubular elements (6) or the risers can be stored within an internal storage zone (14) such as a hold of the vessel (1) or they can be stored in correspondence with an external storage zone (14), such as a deck of the vessel (1). Although the solution according to the present invention is particularly advantageous in the case of an internal storage zone (14) such as a hold of the vessel (1), it presents advantageous solutions also for the application in the case of an external storage zone (14) such as a deck of the vessel (1). In fact, as it will be evident in the light of the following description, the system according to the present invention is applicable also to the racks within which the tubular elements are stored on the deck and is advantageous because the bridge cranes or movement cranes, which imply the previously described risks and dangers related to the conditions of movement of suspended loads, are eliminated.

In particular the present invention advantageously exploits the combination and reciprocal coordination of the movement of the tubular elements (6) that is operated by means of at least two different devices that coordinate with each other to obtain a guided movement of the tubular elements from a storage zone (14), preferably a hold of the vessel (1), to a laying or use zone (2) of the tubular elements, which, for example in the case of a vessel for oil drilling can be (FIG. 1) a derrick (2).

A first inventive device is (FIG. 4, FIG. 5, FIGS. 6A and 6B, FIG. 8, FIG. 9, FIG. 10, FIG. 11, FIGS. 12A and 12B) a movement device (5) which is able to manage the movement of the tubular elements in the storage zone (14):

- for the operations of storage of the tubular elements (6) within the storage zone (14) in the phase of loading of the vessel (1);
- for the operations of taking out of the tubular elements (6) from the storage zone in the phase of their use for the purpose of managing the movement of the tubular elements (6) from the storage zone (14) of the vessel (1) to the laying or use zone (2) of the tubular elements;
- for the operations of movement of the tubular elements (6) in the phase of their recovery managing the movement from the transfer machine (3) of the tubular elements (6) to the storage zone (14) of the vessel.

The movement device (5) interfaces and coordinates (FIG. 20, FIG. 21, FIG. 22, FIG. 23, FIG. 24) with a lifting device (4), which is able to manage the movement of the tubular elements between the storage zone (14) and the deck (16) of the vessel (1):

- for the operations of storage of the tubular elements (6) within the storage zone (14) in the phase of loading of the vessel (1);
- for the operations of taking out of the tubular elements (6) from the storage zone in the phase of their use for the purpose of managing the movement of the tubular elements (6) from the storage zone (14) of the vessel (1) to the laying or use zone (2) of the tubular elements;
- for the operations of movement of the tubular elements (6) in the phase of their recovery managing the movement from the transfer machine (3) of the tubular elements (6) to the storage zone (14) of the vessel.

Furthermore the lifting device (4) can interface with cranes or driving means, such as a tilter device, able to move the tubular element (6) or the riser between the deck (16) and the laying or use zone (2) of the tubular elements. For example in the case of a vessel for oil drilling the lifting device (4) can interface with a crane or another handling device of the riser from the lifting device (4) to a transfer device that can be a transfer device (3) towards the derrick (2). The transfer device (3) can for example be a transfer device of the type usually known by the name of "catwalk", which is considered known for the purpose of the present invention.

In the prior art solutions, since the tubular elements are not completely guided during the movement phases, but are subject to transfers in suspended load conditions, in addition to the fact that the various movement systems are often the object of separate supplies and designs, all the described operations of movement between the storage zone (14) and the deck (16) or laying zone (2) occur by means of manual controls by the operators who are thus directly exposed to dangers during the movement of the tubular elements and who can cause damage to the tubular elements themselves.

The main components of the developed innovative system, on the other hand, can interact and coordinate with one another to automatically manage the whole movement of the tubular elements.

In particular, the movement device (5) that manages the movement of the tubular elements in the storage zone (14) is made up (FIG. 4, FIG. 8, FIG. 9) of a pair of trolleys (17, 18) that are able to translate (FIG. 4, FIG. 5, FIG. 10, FIG. 11, FIGS. 12A and 12B, FIG. 14) along a first direction (49)

in the air space (51) between the stack (52) or column (15) of risers or tubular elements (6) and a wall or supporting structure (25, 62) whose function will be explained in more detail in the following of the present description. The first trolley (17) and the second trolley (18) of the movement device (5) are placed in correspondence with opposite ends of the storage zone (14), that is to say, they are placed on opposite sides with respect to at least one stack (52) of tubular elements and in particular they are placed on opposite sides of at least one stack (52) that are the opposite sides in correspondence with which are the first end (11) and the second end (12) of the tubular elements (6), that is to say, the ends (11, 12) of the tubular elements on which there are the main holes (10) and any holes of the auxiliary lines (13) of the risers or tubular elements (6). The first trolley (17) and the second trolley (18) of the movement device (5) are each provided with a base (44) which is sliding (FIG. 5, FIGS. 6A and 6B, FIG. 7, FIG. 10, FIG. 11) in the first direction (49) by means of first wheels (20) which rest on a first guide (19) which has both the purpose of guiding the sliding of the base (44) and of discharging to the ground the weight both of the respective trolley (17, 18) and of the tubular element supported by the pair of trolleys (17, 18). The first trolley (17) and the second trolley (18) of the movement device (5) are each provided with a frame (26) with substantially vertical development which is integral with the base (44) and translatable jointly and integrally with the base. The frame (26) with substantially vertical development develops for a corresponding height but lower with respect to the height of the hold or of the storage zone (14). On the frame (26) a cursor (27) is vertically sliding. The cursor (27) is provided with at least one engagement means (29, 30) with a corresponding end of the ends (11, 12) of the tubular elements (6). Since the movement device (5) is made up (FIG. 4, FIG. 8, FIG. 9) of a pair of trolleys (17, 18) each of which is provided with a base (44) sliding according to a first direction (49) and since on each base (44) a corresponding frame (26) is mounted, which is able to constitute a supporting and guiding element for the movement according to a substantially vertical second direction (50) of a corresponding cursor (27) provided with engagement means (29, 30) with a corresponding end of the ends (11, 12) of the tubular elements (6), one obtains that by coordinating the movement of the two trolleys (17, 18) it is possible to:

move the first trolley (17) in such a way that the corresponding base (44) slides according to the first direction (49) on the first guide (19) up to the positioning of the base (44) in correspondence (FIG. 4, FIG. 8, FIG. 10, FIG. 11) with a position along the first direction (49) that corresponds to a stack (52) of tubular elements (6) on which is (FIG. 20) a specific tubular element (6) able to be taken;

move the second trolley (18) in such a way that the corresponding base (44) slides according to the first direction (49) on the first guide (19) up to the positioning of the base (44) in correspondence (FIG. 4, FIG. 8, FIG. 10, FIG. 11) with a position along the first direction (49) that corresponds to a stack (52) of tubular elements (6) on which is (FIG. 20) a specific tubular element (6) able to be taken;

move the cursor (27) of the first trolley (17) in such a way that it slides according to the second direction (50) on the frame (26) of the first trolley (17) up to the positioning of the cursor (27) in correspondence (FIG. 4, FIG. 8, FIG. 10, FIG. 11) with a position along the second direction (50) that corresponds to the position in height on the stack (52) of the specific tubular element (6) able to be taken from the stack (52) of tubular elements (6);

move the cursor (27) of the second trolley (18) in such a way that it slides according to the second direction (50) on the frame (26) of the second trolley (18) up to the positioning of the cursor (27) in correspondence (FIG. 4, FIG. 8, FIG. 10, FIG. 11) with a position along the second direction (50) that corresponds to the position in height on the stack (52) of the specific tubular element (6) able to be taken from the stack (52) of tubular elements (6);

activate (FIG. 8, FIG. 10) the engagement means (29, 30) of the cursor (27) of the first trolley (17) in such a way that the engagement means (29, 30) engage with a corresponding first end (11) of the specific tubular element (6) able to be taken from the stack (52) of tubular elements (6);

activate the engagement means (29, 30) of the cursor (27) of the second trolley (18) in such a way that the engagement means (29, 30) engage with a corresponding second end (12) of the specific tubular element (6) able to be taken from the stack (52) of tubular elements (6);

move (FIG. 9, FIG. 21) in a reciprocally coordinated and synchronized way the cursor (27) of the first trolley (17) and the cursor (27) of the second trolley (17) in such a way that they slide in a reciprocally coordinated and synchronized way according to the second direction (50) with the lifting of the specific tubular element (6) able to be taken from the stack (52), said lifting occurring at least up to a condition in which the specific tubular element (6) able to be taken from the stack (52) is out of the encumbrances in height of any other stack (52) of tubular elements present in the same storage zone (14) in which is the specific tubular element (6) able to be taken from the stack (52), preferably said lifting occurring at least up to a condition in which the specific tubular element (6) able to be taken from the stack (52) is aligned in height with a transfer position of the tubular element from the movement device (5) to the lifting device (4) that carries out the following handling phase of the tubular element;

move (FIG. 21, FIG. 22) in a reciprocally coordinated and synchronized way the first trolley (17) and the second trolley (18) in such a way that the corresponding base (44) of the first trolley (17) and that the corresponding base (44) of the second trolley (18) slide in a reciprocally coordinated and synchronized way according to the first direction (49) on the respective first guides (19) up to the positioning of the bases (44) in correspondence with a position along the first direction (49) that corresponds to a longitudinal alignment position with a transfer position of the tubular element from the movement device (5) to the lifting device (4).

Figure 34:
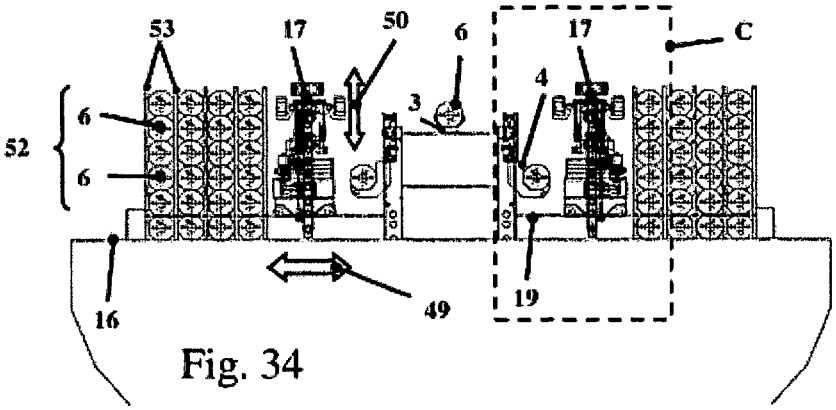
FIG. 34 schematically represents a sectional view of a vessel in which the tubular elements are stored on the deck and shows the applicability of the solution according to the present invention also in the case of storage of tubular elements on the deck.

At this point there can be the transfer of the tubular element from the movement device (5) to the lifting device (4) that carries out the following handling phase of the tubular element and that will be described in the following of the present description. As it will be evident, advantageously, the described system can work also according to the opposite sequence to carry out the loading of the tubular elements or risers (6) from the lifting device (4) to the stacks (52) within the storage space. Although not represented it will be evident that the stacks (52) will be provided with retaining elements able to receive one or more rows of tubular elements or risers (6) arranged in columns, in a way absolutely similar to the retaining elements (53) represented with reference to the solution of storage on the deck (FIG. 34).

Preferably the engagement means (29, 30) of the cursor (27) are made in the form of pins that enter the main hole (10) of the tubular element. However, it will be evident that different embodiments of the engagement means (29, 30) are also possible, which can be considered equivalent and, as such, falling within the scope of the present invention. The solution with the pins is conceived in such a way that each cursor (27) is provided with at least one respective retractable pin (29, 30) suitable to make an insertion or disengagement movement with respect to the main hole (10) of the tubular element. The actions of:

- insertion of one of the pins (29, 30) of the cursor (27) of the first trolley (17) into the main hole (10) of the tubular element in correspondence with the first end (11) of the tubular element;
- insertion of one of the pins (29, 30) of the cursor (27) of the second trolley (18) into the main hole (10) of the tubular element in correspondence with the second end (12) of the tubular element;

perform a grasp action of the tubular element (6) that is thus tightened in correspondence with opposite ends (11, 12) by means of the described engagement means (29, 30) of the first trolley (17) and of the second trolley (18) which from this moment onwards make up reciprocally coordinated driving means constituting as a whole the movement device (5).

The described movement device (5) is in practice made up of a pair of reciprocally coordinated translating columns, which are placed at the two ends of the storage zone (14). The described movement device (5) allows for the movement of the tubular elements within the storage zone both transversely, that is to say, according to the first direction (49), and vertically, that is to say, according to the second direction (50). Furthermore, the described movement device (5) allows to reach any position of the storage zone (14). The two translating columns of the movement device (5) are not physically constrained to each other, as usually occurs in a bridge crane, but their alignment and coordination is ensured by the automation system of the machine. This brings the advantage that, with the same function, the system is lighter and less bulky, which allows for a reduction in the height of the hold or alternatively for an efficient exploitation in height of the existing hold. Furthermore, the device is much more compact with respect to a bridge crane usually used, allowing for its installation on the vessel (1) also once the construction of the vessel has been completed, so that the movement device (5) is not exposed to the weather or to impacts during the phase of construction of the vessel.

Figure 35:
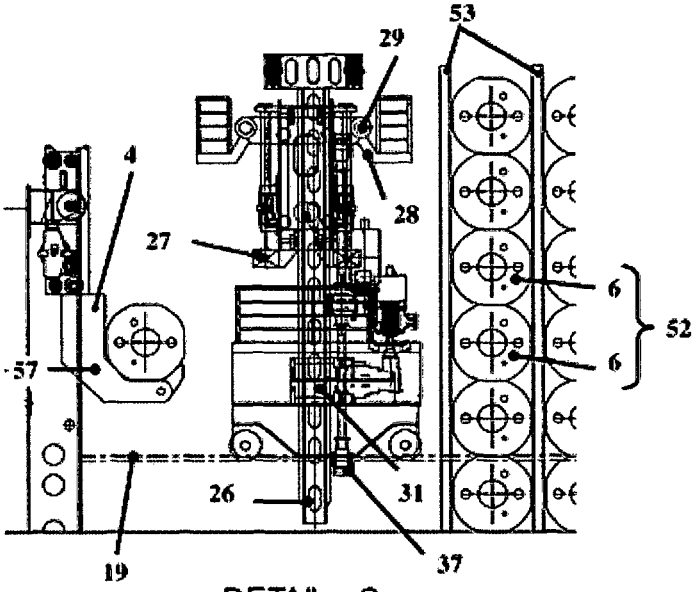
FIG. 35 schematically represents an enlarged view of the detail indicated by "C" in FIG. 34.

The movement device (5) further presents advantageous solutions to allow for an efficient filling of the storage zone (14), both if it is placed within a hold (FIG. 1, FIG. 4, FIG. 20, FIG. 21, FIG. 22, FIG. 23, FIG. 24) of the vessel (1) and if it is placed (FIG. 34, FIG. 35) on the deck (16) of the vessel.

In the solution in which the storage zone (14) is placed (FIG. 34, FIG. 35) on the deck (16) of the vessel (1), the system is in any case advantageous because it allows, in this case too, to prevent the resort to bridge cranes or cranes with the consequent problems concerning the movement of suspended loads that expose the operators to conditions of danger and that expose the tubular elements (6) to possible impacts and damage. Also in the case of application of the system of the invention with the storage zone (14) placed (FIG. 34, FIG. 35) on the deck (16) of the vessel (1), it is possible to obtain a completely guided movement of the tubular elements (6) that prevents the presence of conditions of suspended loads and allows for a high degree of automation of the process.

Figure 15:
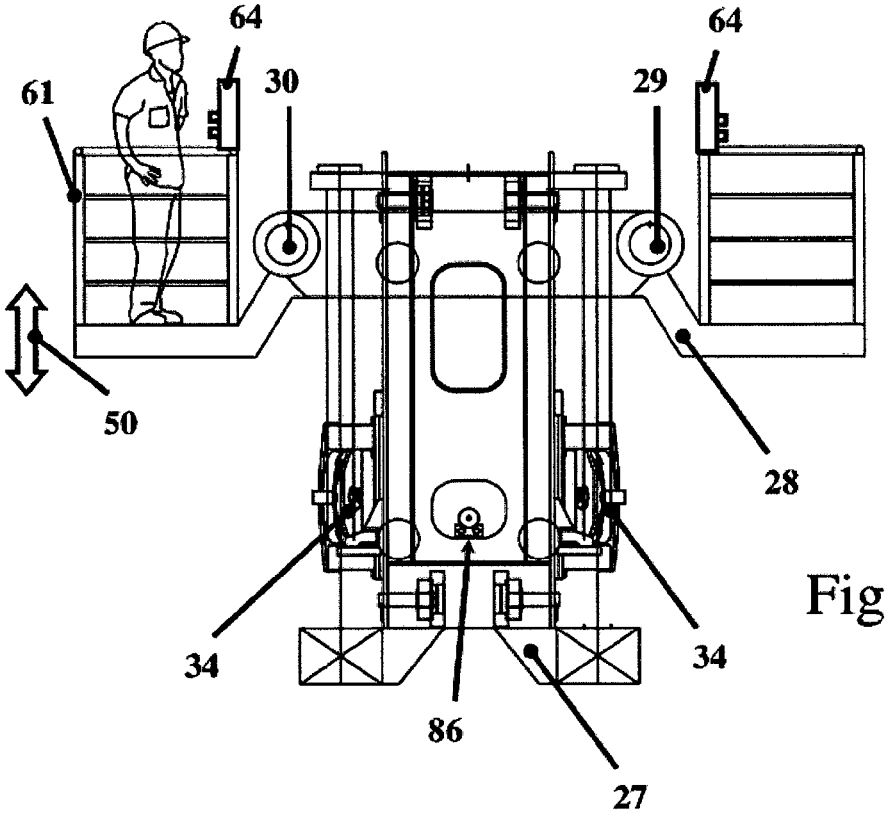
FIG. 15 schematically represents a side view only of the cursor of the movement device for tubular elements made in accordance with the present invention in a first movement condition of the elevation device.
Figure 16:
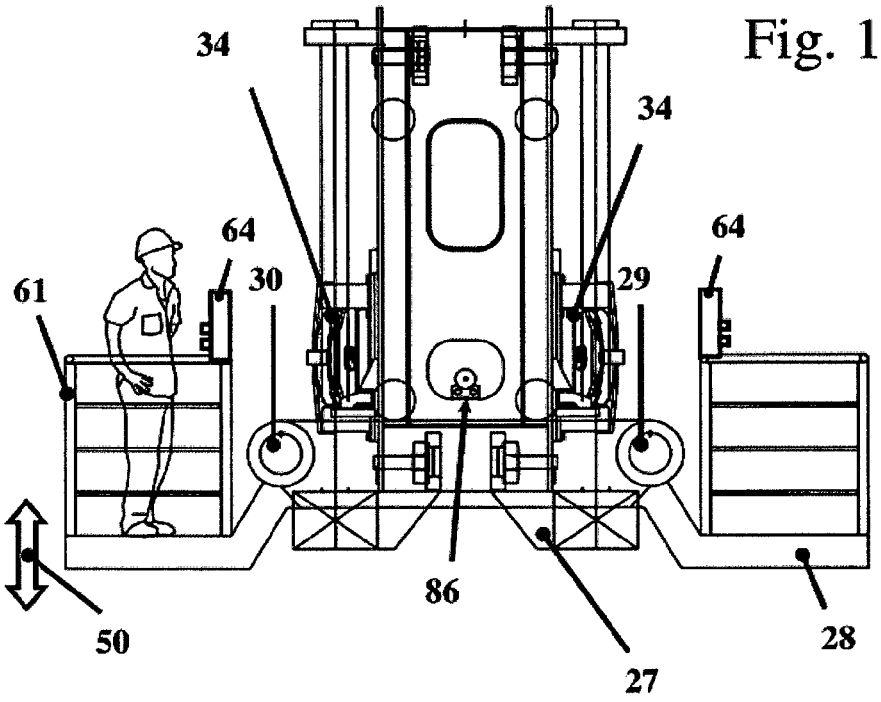
FIG. 16 schematically represents a side view only of the cursor of the movement device for tubular elements of FIG. 15 in a second movement condition of the elevation device.
Figure 17:
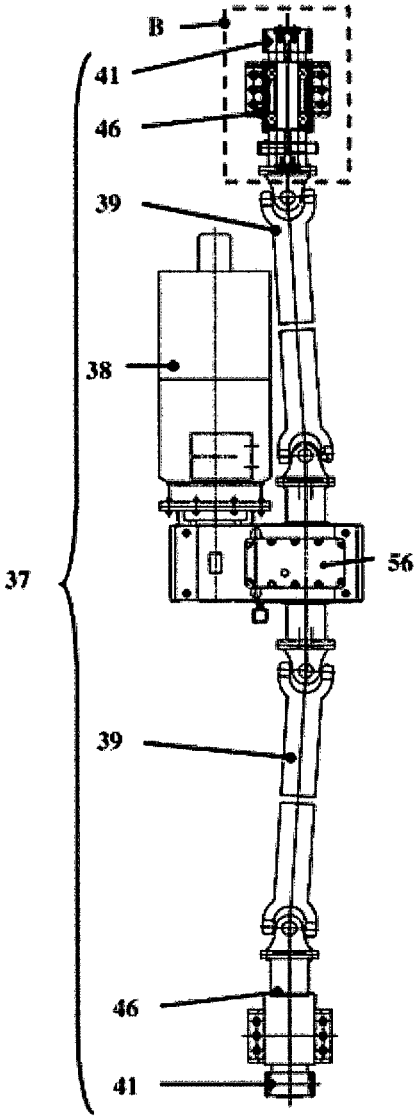
FIG. 17 schematically represents a view of the driving means of the supporting base of the movement device for tubular elements made in accordance with the present invention.
Figure 18:
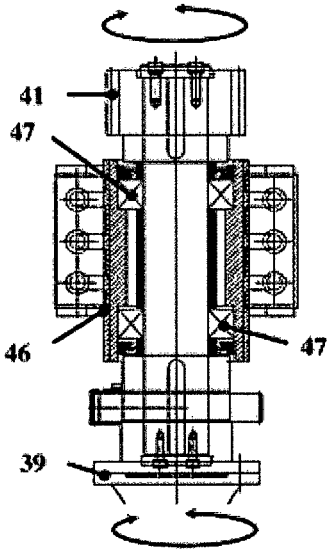
FIG. 18 schematically represents an enlarged view of the detail indicated by "B" in FIG. 17.
Figure 19:
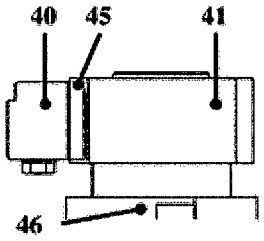
FIG. 19 schematically represents a view of a detail of the driving means of the supporting base of the movement device for tubular elements made in accordance with the present invention.
Figure 22:
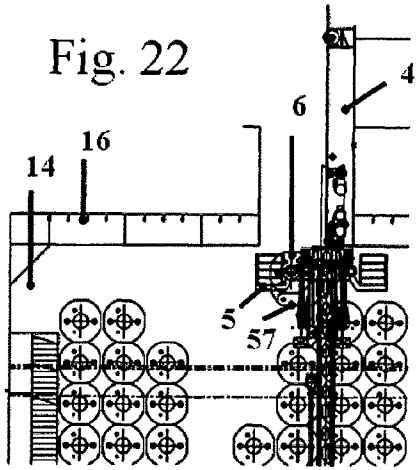
FIG. 20, FIG. 21, FIG. 22, FIG. 23, FIG. 24 schematically show following transfer phases of the tubular elements between devices of the movement system for tubular elements made in accordance with the present invention inside a hold.
Figure 21:
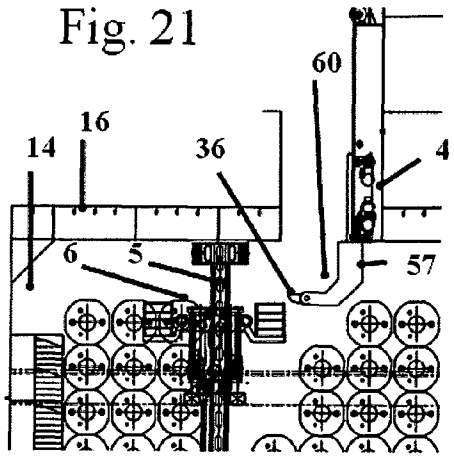
Figure 20:
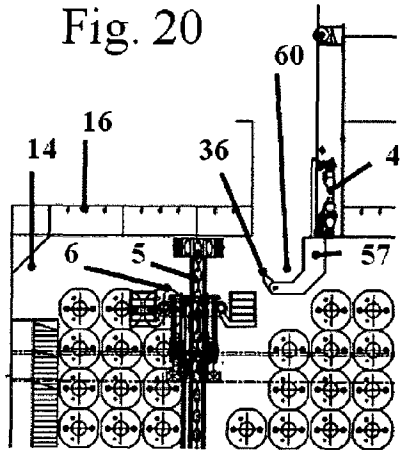
Figure 24:
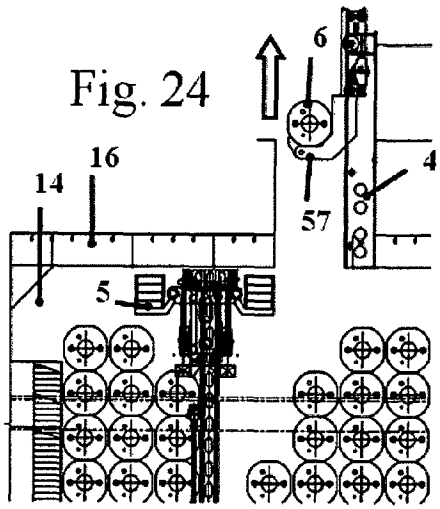
Figure 23:
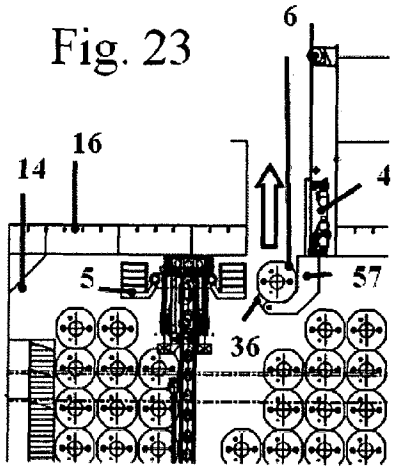

A first particularly advantageous solution consists of the fact that the cursor (27), which is by itself vertically mobile on the frame (26) according to the second direction (50), is further provided (FIG. 15, FIG. 16) with an elevation element (28), which is by itself vertically mobile along the body of the cursor (27) according to the second direction (50). The fact of having the elevation element (28) vertically mobile on the body of the cursor advantageously allows to optimize the filling of the hold as it is necessary to observe that the engagement means (29, 30) must be placed at such a height as to allow them to store and take (FIGS. 12A and 12B) the tubular elements in correspondence with the bottom of the hold or the floor of the deck. Moreover, the engagement means (29, 30) must be placed at such a height as to allow for the transfer (FIG. 21, FIG. 22, FIG. 23) of the tubular elements (6) onto the lifting device (4). These two requirements for the engagement means (29, 30) are in contrast with each other because:

- to store and take (FIGS. 12A and 12B) the tubular elements in correspondence with the bottom of the hold or the floor of the deck the engagement means (29, 30) must be placed at the lowest possible on the cursor (27);
- to allow for the transfer (FIG. 21, FIG. 22, FIG. 23) of the tubular elements (6) on the lifting device (4) the engagement means (29, 30) must be placed at the highest possible on the cursor (27) in order to fill the hold in height as much as possible;

The fact of having an elevation element (28) which by itself is vertically mobile along the body of the cursor (27) according to the second direction (50) allows to move vertically the engagement means (29, 30) and, therefore, the tubular element supported by them in order to allow the tubular element to rest on the ground and also its lifting over the maximum height allowed of the stacks (52) for the transfer of the tubular element from the movement device (5) to the lifting device (4).

Further advantageously the cursor (27) is provided with two different engagement means (29, 30) that are arranged spaced from each other along the first direction (49) and essentially symmetrical with respect to an axis of symmetry of the cursor (27). In this way it is possible to use:

- a first pin (29) to take or store a tubular element in correspondence (FIG. 10) with a first side (54) of the storage zone (14);
- a second pin (30) to take or store a tubular element in correspondence (FIG. 11) with a second side (55) of the storage zone (14).

In practice by this solution one manages to fill the storage space (14) from an end in correspondence with the first side (54) to the other end in correspondence with the second side (55) in such a way as to approach as much as possible to the ends themselves and fill the storage space (14) almost completely.

Figure 45:
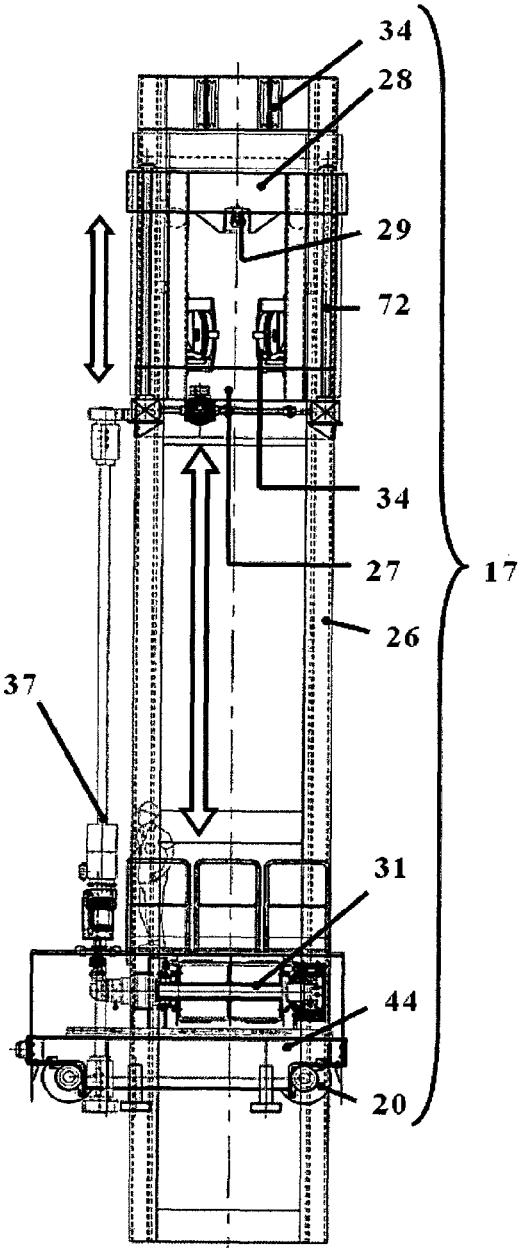
FIG. 45 schematically represents a front view of a different embodiment of the trolley of the movement device for tubular elements made in accordance with the present invention.
Figure 46:
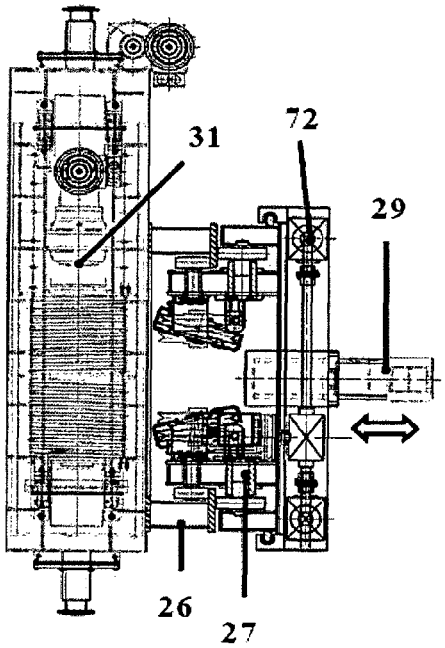
FIG. 46 schematically represents a plan view of the trolley of FIG. 45.

However, in different embodiments it will be sufficient to resort (FIG. 45, FIG. 46) to trolleys (17, 18) equipped with cursors (27) that are provided with elevation elements (28) with only one engagement means (29) placed in a median position with respect to the width development of the trolley. In this solution the side filling of the hold can be lower with respect to the previously described solution with two engagement means (29, 30). However, the solution with one single engagement means (29) can be advantageous if the storage needs are not particularly pressing, in the sense that the space available on the vessel is not a problem for the storage of the tubular elements (6). In that case the load on the trolley (17, 18) will be more balanced and also the cost of the trolley will be lower due to the absence of the double engagement means and of the related movements.

Figure 44:
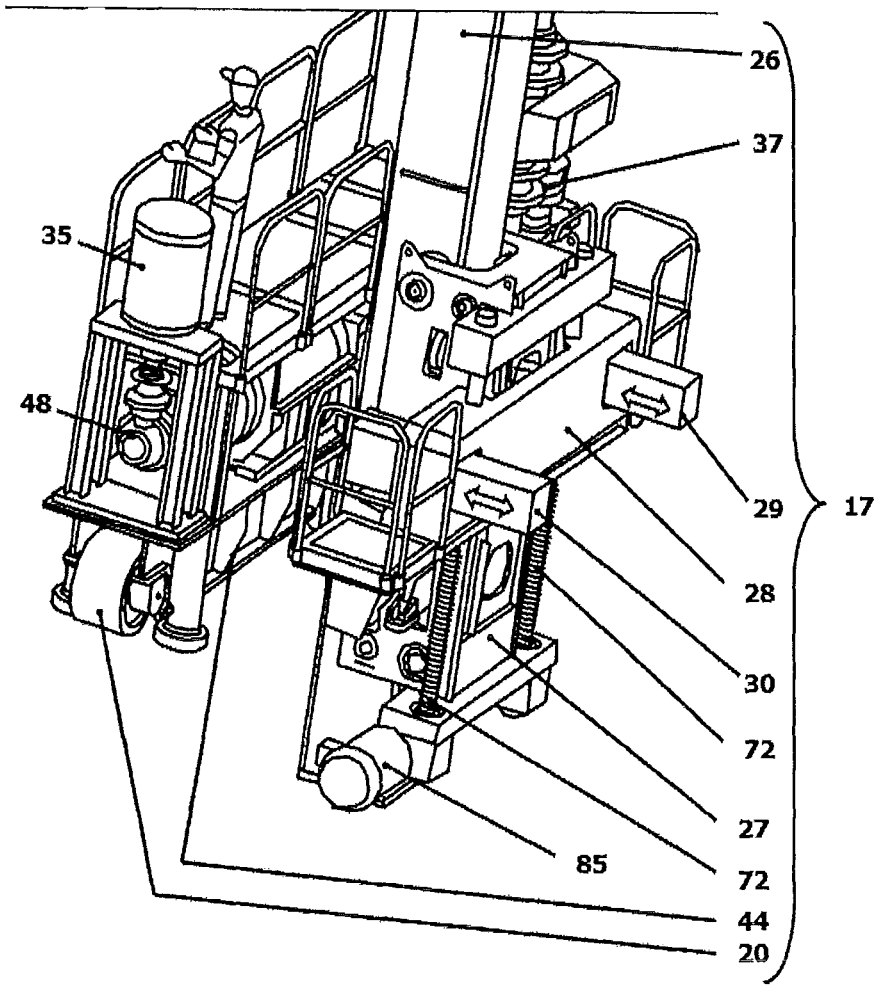
FIG. 44 schematically represents a perspective view of one detail of the trolley of FIG. 43.

Advantageously the engagement means or pins (29, 30) can be shaped (FIG. 44) with an essentially quadrangular shaped section with radiused edges according to connection radiuses essentially corresponding to the internal radius of the riser. The engagement means or pins (29, 30) are provided with at least one portion which is covered by a soft or friction material, such as a gummy material or plastic material. The quadrangular shape is particularly advantageous as it allows to have two contact areas spaced from each other between the head (67) and the inside of the tubular element, ensuring greater stability with respect to a solution with a circular head, which in any case will be an adoptable solution, although less preferred with respect to the solution with the quadrangular head. Furthermore, for the purpose of limiting the risk of possible damage, one provides the presence of the covering material of the external surface of the engagement means or pins (29, 30) at least in correspondence with the zones of contact with the tubular elements (6). Each pin (29, 30) is retractable (FIG. 10, FIG. 11):

- both to allow to use one pin or the other according to the fact that one has to move a tubular element in correspondence (FIG. 10) with a first side (54) of the storage zone (14) or in correspondence (FIG. 11) with a second side (55) of the storage zone (14);
- and to allow (also in the case of a solution with one pin only) to position the cursor (27) in correspondence with a first end (11) or a second end (12) of a tubular element in an alignment condition between the pin and the main hole (10) before extracting the pin for its insertion into the main hole (10) in order to tighten the tubular element between the opposite pins of a first trolley (17) and second trolley (18) for the purpose of taking (FIG. 8, FIG. 9) the tubular element itself.

The first pins (29) and the second pins (30) of the just described elevation elements (28) as well as the third pins (66) of the tilter device (65) that will be described in the following of the present description, can have the previously described quadrangular configuration (FIG. 43, FIG. 44, FIG. 48, FIG. 49). The pin (29, 30, 66) can slide (FIG. 48, FIG. 49) within a holder (92), but the head (67), which is the part suitable to get in contact with the tubular element (6), always remains external with respect to the holder (92) also in the withdrawn position of the pin (29, 30, 66). This solution allows to be able to adopt interchangeable heads (67) without having to modify the rest of the mechanism of the pins, for example for the purpose of replacement in case of wear or for the purpose of allowing the handling of tubular elements having shapes very different from each other with a same device of general applicability, which will be adapted to the different needs by simply replacing the head (67) only and keeping unchanged the rest of the pin (29, 30, 66) and of the movement device of the pins themselves to obtain the movement between the extracted and withdrawn positions.

The whole unit of the pin (29, 30, 66), that is to say, comprehensive of the pin itself, of the relative holder (92) and of the relative pin actuator (88), has been designed in such a way as to be able to be installed in a removable manner, for the purpose of facilitating and fastening any possible replacements. The pin (29, 30, 66) slides on guide shoes inside the holder (92) and a suitable greasing system is provided to reduce friction and keep the system efficient.

The pin (29, 30, 66) is movable between the extracted position and the withdrawn position by means of a pin actuator (88) which acts in extension and in traction between the pin itself and the holder (92). The pin actuator (88) can be an electrical actuator or a hydraulic cylinder which is advantageously placed below the unit and external with respect to the pin and holder improving accessibility for maintenance or replacement although remaining in a protected position and not interfering with the tubular element during the operations of movement and taking out.

The positioning of the pin (29, 30, 66) opposite the tubular element (6) can be made in different ways according to the degree of automation that one wishes to obtain. A particularly simple and economical solution (FIG. 48, FIG. 49) provides the definition of a Cartesian Plane of movement coordinates on which Cartesian Plane the positions of the tubular elements within the retaining elements (53) are previously defined. By means of signals of the movement encoders of the various motors it is possible to carry out a sufficiently precise positioning of the pin (29, 30, 66) in correspondence with the tubular element (6) to be taken out from a stack (52). Alternatively one can also provide a vision and recognition system based on cameras that also enables a remote control by the operator and if necessary also inspection operations with the automatic recognition of any problems, faults, damage, etc. A different solution provides the resort to optical pointing systems that allow to detect the position of the head flange of the tubular element or its end edge in such a way as to control in a more accurate way the positioning of the pin with respect to the insertion hole.

Whatever the choice for the positioning of the pins (29, 30, 66) it remains appropriate to provide mechanical position verification means for safety purposes. For this purpose three sensors are adopted, which are made up of a body mobile by contact with the tubular element (6), which mobile body following the contact approaches an inductive sensor that detects its position identifying any possible contact occurred with the tubular element:

- a first sensor (89), when activated by contact with the tubular element (6), stops the lowering of the elevation element (28) or of the cursor (27) which move the pins (29, 30) vertically in the first trolley (17) or in the second trolley (18), in this way giving the certainty that the pin (29, 30) is actually in front of the insertion hole of the tubular element and only in this condition the extraction of the pin is actually enabled by insertion into the main hole (10) of the tubular element (6), for example in the form of a riser;
- a second sensor (90) which, when activated, stops the exit of the pin towards the extracted position, giving the certainty that the whole body of the pin (29, 30) is completely inserted in the hole (10) of the tubular element, only in this condition the lifting control of the tubular element being subsequently enabled, which in this condition is correctly tightened by a pair of retractable pins in correspondence with opposite ends, that is to say, by a pin (29, 30) of the first trolley (17) on the one side of the tubular element (6) and by a pin (29, 30) of the second trolley (18) on the opposite side of the tubular element (6) with respect to the side in correspondence with which the insertion of the pin (29, 30) of the first trolley (17) occurred;
- a third sensor (91) which, when active, confirms that the tubular element (6) is in a suspended condition on the respective pin and its movement can proceed without particular attention because the taking out phase has been concluded correctly.

As can be seen the sensors (89, 90, 91) not only confirm the positioning, but ensure to prevent impacts between the pin (29, 30) and the tubular element (6) sequentially enabling the movements. Obviously, the automation system and in particular the control unit (63) controls both trolleys (17, 18) and the respective elevation elements (28) and cursors (27) in correspondence with the opposite ends of the tubular element (6), the control unit (63) proceeding with the sequence of the movements only when both systems give a positive result, that is to say, when both the sensors (89, 90, 91) of the pin (29, 30) of the first trolley (17) and the sensors (89, 90, 91) of the pin (29, 30) of the second trolley (18) confirm that the tubular element (6) has been taken out correctly.

Should the shape or type of tubular elements (6) be changed, the mechanical actuators that enable the sensors can change in their shape and size, too, but the control logic remains the same. The real sensors that are operated by the mechanical actuators represented (FIG. 48, FIG. 49) are of the inductive type.

By the combination of the two just described solutions related to the presence of the first pin (29) and of the second pin (30) and also to the presence of the vertically mobile elevation element (28), it is possible to obtain an efficient and nearly complete filling of the storage space (14) both along the first direction (49), that is to say transversely, and along the second direction (50), that is to say vertically.

The movement of the cursor (27) according to the second direction (50) is controlled by (FIGS. 6A and 6B, FIG. 7, FIGS. 12A and 12B, FIG. 13, FIG. 14) cursor driving means (31) which are preferably mounted on the base (44) of the trolley and are preferably made up of a first motor (35) which by means of a first gear-reducing device (48) actuates a winch (32), preferably a pair of winches (32) which, by means of one or more cables (33) that slide on first snub pulleys (34), allow for the lifting and the lowering of the cursor (27) which is advantageously constrained and guided in the vertical movement by means of the frame (26). In the solution shown the movement of the cursor (27) according to the second direction (50) is controlled by means (FIG. 43) of the first motor (35) which by means of the first gear-reducing device (48) actuates the pair of winches (32) which are controlled in a reciprocally synchronized way by means of one single drive shaft. There are two cables (33), each sliding on respective first snub pulleys (34). Each of the two cables (33) winds on a respective winch of the pair of winches (32) and each cable (33) preferably makes a double trip back and forth between the winch and the first snub pulleys (34). Advantageously, each of the two cables (33) is able to support the whole cursor (27) independently of the other of the two cables (33), in such a way that also in the case in which one of the two cables failed, the other would be able to support on its own the whole weight of the cursor (27) and of any loads. In practice a double section winch is obtained with two symmetrical cables and with 100% redundancy. Advantageously, one can provide a braking system made up of a disc (42) and corresponding brakes (43) or made up of a pack of braking discs that are placed in correspondence with an output shaft from the first motor (35) to the at least one winch (32) or in correspondence with an input shaft of at least one winch (32).

This brake mainly has safety purposes because in case of breakdowns it intervenes to stop the lifting system. In fact the brake is of the type normally tightened in braking and, for the normal operation of the system, it must be kept constantly deactivated by means of a specific control. In this way in case of breakdowns or failures, at the drop of the control that keeps the brake released, it will intervene and immediately stop the system. Furthermore the brake can also be useful to brake the descent movement of the cursor when it supports the weight of a tubular element (6) during transport. Furthermore in combination with or as an alternative to the disc (42) with corresponding brakes (43) directly mounted on the output shaft of the first motor (35), one can also provide a solution in which a pack of braking discs is mounted between the winch (32) and the first gear-reducing device (48).

In case of failure of one of the first trolley (17) and second trolley (18), for example in case of failure of one of the motors of the latter, the described braking system will intervene on the respective faulty trolley and will also control the activation of the braking system of the other trolley that is not subject to failure, preventing any tubular element that is being carried from possibly bending due to the stopping of one of the two trolleys while the other continues its stroke or movement.

A problem that one had to face with the described configuration, there being a cursor (27) that slides on wheels along the frame (26) and that is controlled by two distinct and independent cables controlled in a synchronized way, is due to the fact that with such a configuration only one of the two cables is actually in the traction condition, for example due to the fact that a cable is looser with respect to the other, or due to the asymmetry of the load, etc. As a consequence, a compensator device system (86) was realized (FIG. 50, FIG. 51), which allows to balance for any traction difference between the two cables. The compensator device (86), by oscillating, compensates for any different traction of the two cables. For example it can be provided that the compensator device (86) can compensate for a different length of the cables, due for example to the progressive extension of the latter due to wear. The compensator device (86) will be preferably oscillating between a central position and two positions of maximum inclination that will be preferably corresponding to an inclination of +/−15 degrees with respect to the central position, even more preferably of +/−10 degrees with respect to the central position. The positions of maximum inclination can be defined by means of rabbet elements that prevent inclinations exceeding the limit value set mechanically. One can also provide sensors that generate a corresponding signal of reaching of the maximum inclination limit, in which case the system is no longer able to compensate for further differences between the cables and it is necessary to schedule a maintenance intervention. Therefore the cursor (27) will be provided with a compensator device (86) intended for the passage of the two cables (33), the compensator device (86) being suitable to incline alternatively on the one side or on the opposite side under the action of the traction difference present between the two cables (33), said inclination of the compensator device (86) compensating for the traction difference present between the two cables (33) in such a way as to bring them in a condition of equal traction and preventing one cable only from being subject to all the stress. The compensator device (86) comprises rabbet elements that prevent inclinations of the compensator device (86) exceeding limit values set mechanically, said rabbet elements preferably limiting the inclination of the compensator device (86) to angles included between +/−15 degrees with respect to the balance position in which the two cables (33) exert an equal tensile force, even more preferably limiting the inclination of the compensator device (86) to angles included between +/−10 degrees.

Therefore, in the embodiment shown (FIG. 15, FIG. 16, FIG. 50, FIG. 51), for the lifting of the cursor (27) along (FIG. 5, FIG. 6, FIG. 7) the frame (26) some cables (33) are used. The connection of the cables (33) on the cursor (27) occurs by means of the compensator device (86) in order to constantly uniform the tension on both sides and cancel the effect of a possible future different extension between the two cables (33) present. As observed, the maximum inclination of the compensator device (86) can be limited to the angles indicated by means of solid mechanical pawls. In this way, should one cable of the two cables (33) that are used for the lifting break, the other cable is still able to support the whole load and in that case the control unit will be able to bring the load and the cursor (27) in a safety position. This means that the load is moved with a safety factor of 100% because also in case of breaking of one of the two cables, the other cable (33) is able to support the whole system and any load present allowing to bring the system in complete safety towards a locking position. The cables (33) are connected to the compensator device by means of threaded tighteners with eyelet or fork and are fastened with a grommet nut and lock nut. The end of the cables in its turn is provided with a cable terminal with an eyelet or fork. The rough adjustment of the difference between the two cables will be carried out by acting on the thrust ring of one of the two drums. The fine adjustment and the following corrections will be carried out with the tie-rods of the compensator device (86). The compensator device (86) is placed in the low part of the elevator to allow this to be able to exploit all the height of the guiding plate without interfering with the wheels or the snub pulleys. As a result the connections are realized on the sides of the trolley. The position of the compensator device (86) is controlled by three limit stops, the central one says that the compensator device (86) is horizontal, while the other two give the signal that the compensator device (86) is too inclined on the one side or on the opposite side.

Moreover, there are also some safety limit stops on the stroke of the cursor (27) of the trolley (17, 18).

The movement of the trolley (17, 18) according to the first direction (49) is guided (FIGS. 6A and 6B, FIG. 7) by means of a second guide (21) placed below with respect to the development in height of the frame (26) and by means of a third guide (23) placed above with respect to the development in height of the frame (26). The second guide (21) is made in the form of a rail on whose opposite sides opposite pairs of second wheels (22) engage, which are arranged on a plane essentially orthogonal to the plane on which the frame (26) of movement of the cursor (27) develops. The third guide (23) is made in the form of a rail on whose opposite sides opposite pairs of third wheels (24) engage, which are placed on a plane essentially orthogonal to the plane on which the frame (26) of movement of the cursor (27) develops. This solution is advantageous because the frame (26) can also have a considerable development in height and must support the weight both of the cursor (27) and of the tubular element (6) carried. By means of the solution shown with opposite pairs of second wheels (22) and third wheels (24) that engage on respective rails one advantageously gets free of the action of transmission of the motion to the trolley for the translation according to the first direction (49) and of the action of discharge of the weight resting on the trolley by effect of the presence of the tubular element (6) that is practically supported in an overhanging way laterally with respect to the trolley. In this way the force applied by the tubular element by effect of the gravity that would tend to turn the trolley over is effectively opposed by the second and third wheels and by the respective rails, while it does not rest on the trolley driving means (37). The movement of the trolley (17, 18) is controlled by means (FIGS. 12A and 12B, FIG. 17, FIG. 18, FIG. 19) of the trolley driving means (37) which are preferably made up of a third motor (38) that by means of a second gear-reducing device (56) is coupled with two transmissions (39) which respectively put in rotation fourth wheels (41), of which:

- an upper fourth wheel (41) supported by means of a case (46) by means of bearings (47), the upper fourth wheel (41) being placed on the upper part with respect to the development of the frame (26) according to the second direction (50) which is a gear-wheel that couples with a fourth guide (40) in the form of a rack (45);
- a lower fourth wheel (41) supported by means of a case (46) by means of bearings (47), the lower fourth wheel (41) being placed on the lower part with respect to the development of the frame (26) according to the second direction (50) which is a gear-wheel that couples with a fourth guide (40) in the form of a rack.

The transmissions (39) are preferably cardan shafts, which by means of the second gear-reducing device (56) receive the motion from the third motor (38) thus being reciprocally synchronized in order to control the movement of the trolley (17, 18) by means of the just described rack system.

As observed, the cursor (27) is provided with an elevation element (28) which is itself vertically mobile along the body of the cursor (27) according to the second direction (50). The movement of the elevation element (28) occurs (FIG. 43, FIG. 44) advantageously by means of a worm screw system. A second motor (85) acts on the worm screw system in such a way that the elevation element (28) is controlled in lifting and in lowering along the screws (72).

All the machines of the supply communicate between each other through a central control system and in particular by means of the control unit (63). The control unit (63) receives the signals from the inverters of the electric motors of control of the various devices to operate their control and their synchronization. For example between the first trolley (17) and the second trolley (18) of the movement device (5) "an electrical axis" is obtained that ensures simultaneity in the movements. The trolleys (17, 18) are also provided with sensors connected to the control unit (63) for the coordination and the synchronization of the movements, to simplify the communication between different devices and to put in safety the handling system as a whole in case of breakdowns of one or more devices. This command and control logic can be assisted by other control systems such as with the aid of a video camera that enables other management modes also in situations other than the operative ones, such as the manual advancement for maintenance and control activities with the presence of the operator on the trolley (17, 18) or remotely by means of the visualization of the video signals of the video camera on a remote control monitor or still by means of diagnostic and automatic inspection systems by means of video cameras that control the movements of one or more trolleys (17, 18) to perform an automatic inspection by means of video cameras of the stored tubular elements (6) prior to their actual use.

As observed (FIG. 5) each trolley (17, 18) moves along first guides (19) and is provided with a frame (26) with vertical development along which the cursor (27) slides which in its turn is provided with one or more grasping pins (29, 30) if necessary mounted on an elevation element (28)

that increases the vertical stroke achievable with the cursor (27). The cursor (27) is vertically mobile on the frame (26) and is lifted by means of cables (33) which are operated by a lifting system comprising the two winches (32) controlled by the first motor (35). The winches are placed on the trolley (17, 18) down and near the frame (26) with vertical development along which the cursor (27) slides. Laterally there are supporting seats to enable the support of the cursor (27) when it is not used for the sliding along the frame (26). The control of the winches (32), which are preferably controlled by one single common shaft, occurs by means of a position encoder that communicates with the control unit (63). For example the encoder can be controlled by a mechanical system provided with a chain. The electrical system of each trolley (17, 18) preferably consists of three sensors for the detection of the inclination of the compensator device (86), as previously described, two proximity sensors for stopping the movement of the trolley (17, 18) at the functional end limits of the first guide (19), an alarm sensor that signals an excessive elongation of the chain of the encoder, possible position sensors of the cursor (27) along the frame (26) during the vertical movement of the cursor itself or sensors in correspondence with the respective lower and upper limit of the frame. In correspondence with the upper end of the frame (26), which in practice constitutes a vertical column of sliding of the cursor (27), there preferably is a robust mechanical stop device for preventing the cursor (27) from going beyond the upper stroke limit and one can provide mechanical stop devices also in correspondence with the end positions of the first guide (19) along which the trolley (17, 18) moves.

The cursor (27) is guided (FIG. 43) along the frame by means of two rear main wheels placed in correspondence with the upper end of the body of the cursor (27) and by means of two front main wheels placed in correspondence with the lower end of the body of the cursor (27). Longitudinally with respect to the vessel the trolley is guided by means of four rollers two of which are placed on the upper part and two are placed on the lower part and is fastened by four further auxiliary rollers in an opposite position with respect to the main rollers to prevent overturning. The four main rollers support the load on the ground while the side rollers are able to discharge the lateral or longitudinal loads due to the weight of the tubular element or to the movements of the vessel. The auxiliary rollers during normal operativeness do not touch the respective guides except in the case in which there are longitudinal acceleration peaks or movements of the ship, impacts, etc.

Figure 50:
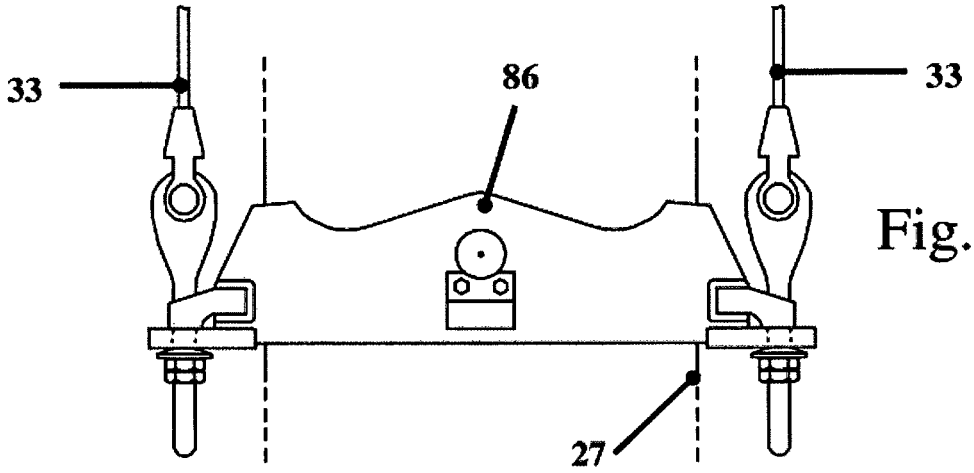
FIG. 50, FIG. 51 represent an embodiment of the balancing system of the traction of the lifting cables.
Figure 51:
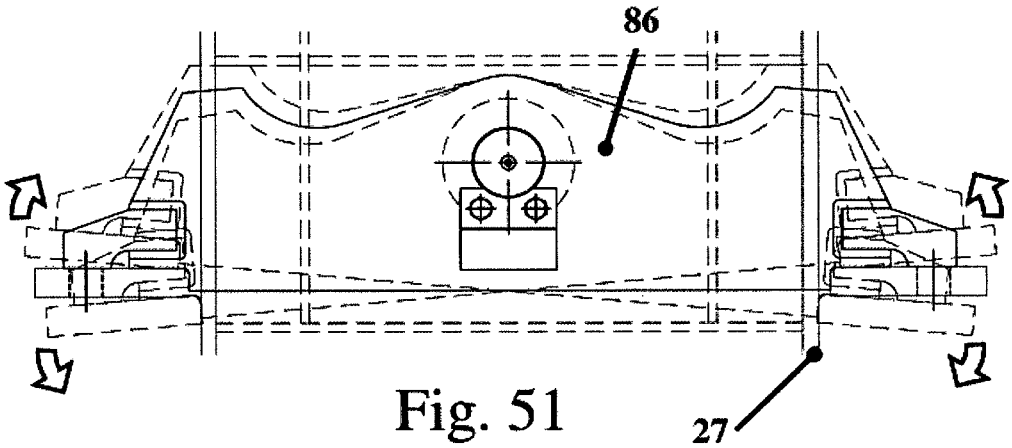

The lifting system or cursor driving means (31) consist of two cables (33) that wind on the two winches (32) with at least five safety turns that are maintained also in the case of maximum release of the cable. From the winch the cable (33) passes along first fixed pulleys that are applied on the walls of the vessel itself or on the fixed supporting structure of the whole system. The cable (33) then reaches (FIG. 43) the top first pulleys (34) that are on top of the frame (26) along which the cursor (27) moves. At this point the cable is transmitted downwards to pass through side pulleys of the cursor itself and be transmitted upwards again to carry out an additional passage on the top first pulleys (34) that are on top of the frame (26) along which the cursor (27) moves and finally go back towards the cursor (27) to reach the compensator device (86). The cables will preferably have a diameter of 26 mm and are fastened to the compensator device (86) by means of eyelet or fork systems (FIG. 50). The nut and lock nut system allows to adjust the tension of the cables (33) in order to set a relative tension of one with respect to the other that is such as to maintain the compensator device (86) in an approximately horizontal position. If the elongation difference between the cables (33) is excessive, that is to say, such as not to allow its adjustment by the indicated system, then it is necessary to act on the number of windings of the cable (33) on the drum of the winch (32) or to act on the angular position of the winches (32).

The encoder system includes an encoder box installed on top of the frame (26) near the first pulleys (34). The box protects the encoder and the respective electric contacts. The encoder is axially coupled with an axis that ends with an external pinion that is connected to a chain. The chain is tensioned by means of an idle wheel in correspondence with the lower end. Said idle wheel is mounted on a hinged support that is tensioned by means of a spring. Both ends of the chain are connected to a compact connection arm screwed to the cursor (27). Between the upper end of the chain and the connection arm a tensioning device is mounted for the automatic adjustment of the tension of the chain. When the cursor (27) moves vertically along the frame (26), it also moves the chain and as a consequence the upper gear-wheel that controls the encoder. In this way the automation system and the control unit will know in every moment the vertical position of the cursor (27) along the frame (26) and can coordinate and synchronize the vertical movement of the two cursors (27) of the first trolley (17) and of the second trolley (18).

Since the stroke of the chain may also be of 17 meters, to limit any possible oscillations, guide lines of the chain along the frame (26) are used.

The sensors that measure the position of the compensator device (86) are made up of:

- an intermediate proximity sensor that detects when the compensator device (86) is in a substantially horizontal position corresponding to the normal operating conditions;
- an upper proximity sensor and a lower proximity sensor that provide an alarm signal to the control unit when the compensator device (86) is inclined beyond the maximum limit set for the purpose of warning that a maintenance intervention is necessary to adjust the tension of the cables (33).

The lifting system includes the two winches (32) controlled by the first motor (35). Alternatively to the solution represented with a motor placed at an end and a shaft common to the two winches, one can also resort to a solution in which a double-shaft central motor controls both winches. In the solution shown the first motor (35) that controls the winches (32) is connected to a first planetary gear-reducing device (48) integral with one of the two winches (32). The winches are directly welded on the rotation drive shaft and are supported by means of end bearings on both sides.

The winches and the moving members are preferably protected by protection cases.

The movement device (5) coordinates (FIG. 20, FIG. 21, FIG. 22, FIG. 23, FIG. 24) with the lifting device (4) that carries out the following handling phase of the tubular element to move it towards the tilter device that loads it onto the transfer device (3), which in the case of tubular elements (6) in the form of risers can be the device usually indicated by "catwalk" that transfers the risers to the derrick (2) also dealing with their verticalization.

Figure 36:
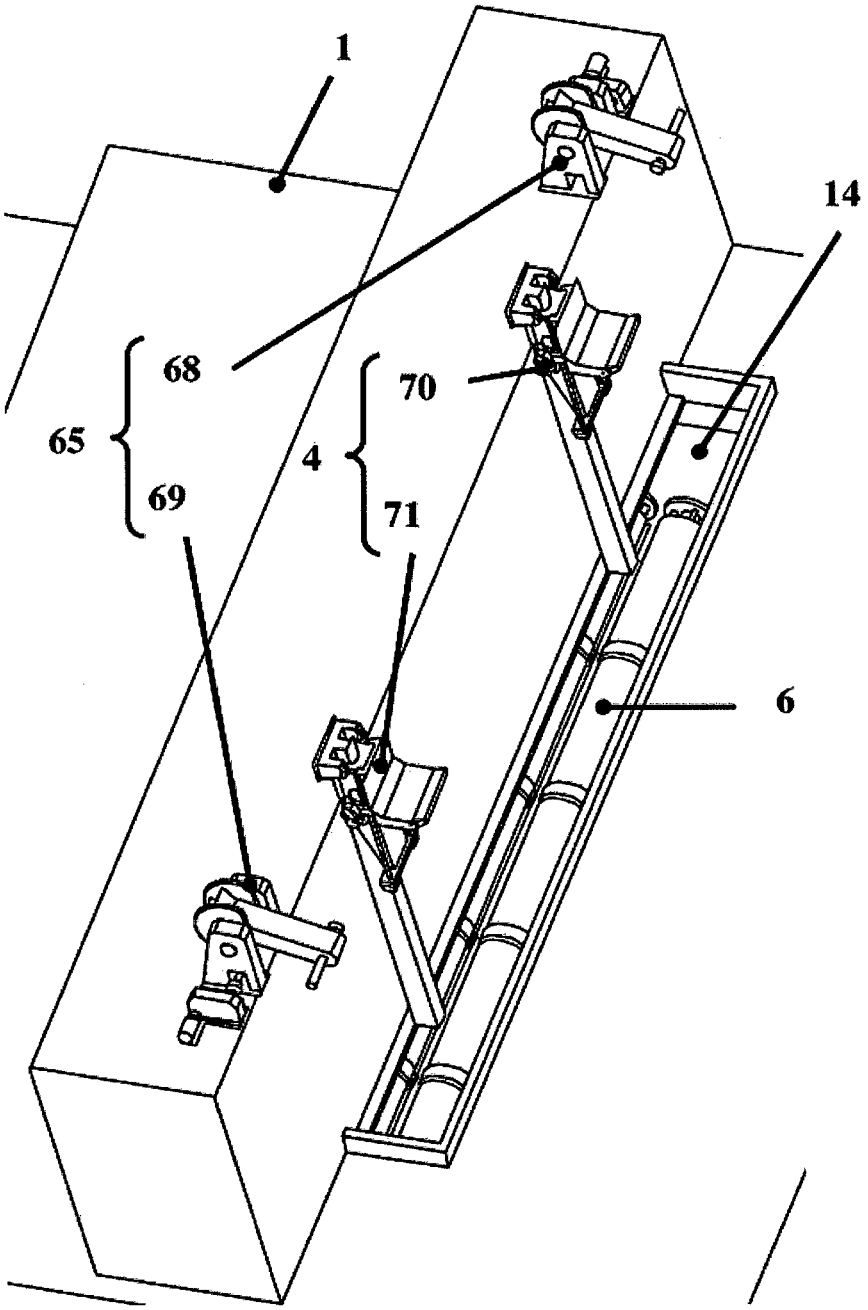
FIG. 36 schematically represents a perspective view showing the reciprocal position of the lifting device and tilter device of the system for the handling of tubular elements made according to the present invention.

Advantageously the lifting device (4) is preferably installed in correspondence with an existing wall of the vessel and near the hatch of access to the storage zone (14). It is made up (FIG. 36) of a first elevator (70) and a second elevator (71) that are moved in a reciprocally coordinated and synchronized way to carry out the lifting and lowering operations of a pair of cradles (57). The cradles (57) form a deposition seat (60) onto which the movement device (5) lays (FIG. 22, FIG. 23) the tubular element (6) in case of taking out from the storage zone (14) or from which the movement device (5) takes out the tubular element (6) in case of loading of the tubular elements (6) towards the storage zone (14).

Figure 31:
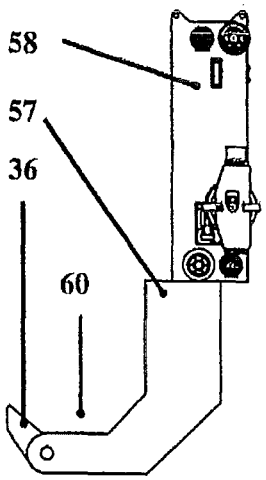
FIG. 31 represents a schematic side view of a first embodiment of the lifting device made in accordance with the present invention.
Figure 32:
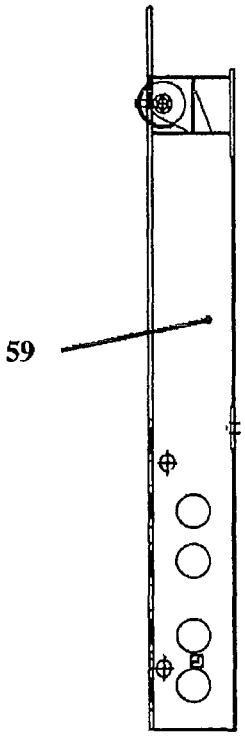
FIG. 32 represents a schematic side view of the guide of the lifting device of FIG. 31.
Figure 33:
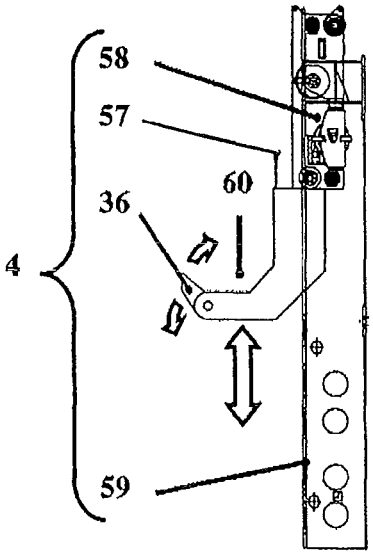
FIG. 33 represents a schematic side view of the lifting device of FIG. 31 mounted on the guide of FIG. 32.

The cradles (57) are preferably provided with a retractable tooth (36) which is able to be moved between a first position (FIG. 21) in which the tooth (36) is bent downwards leaving completely free the access to the deposition seat (60) for the movement within it of the tubular element (6) and a second position (FIG. 23, FIG. 31) in which the tooth (36) is bent upwards acting as restraint means of the tubular element (6) within the deposition seat (60) during the lifting or lowering phases of the cradles (57). Each cradle (57) is mounted on a respective first body (58) which can slide vertically in lifting and in lowering along (FIG. 32, FIG. 33) a stanchion (59) that guides its movement and on which the driving means of the first body (58) supporting the cradles (57) are installed.

Figure 29:
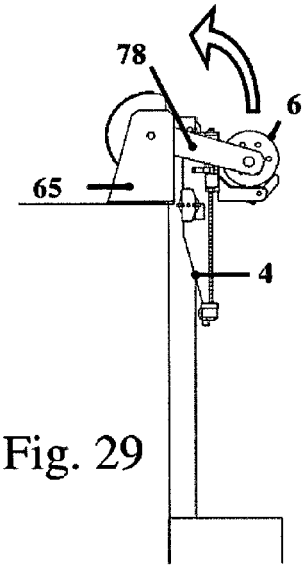
Figure 38:
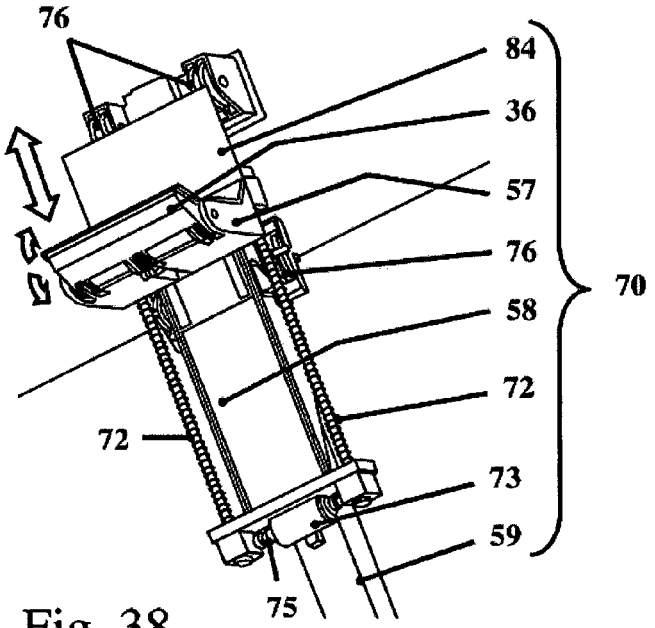
FIG. 38 schematically represents a perspective view of a second embodiment of the lifting device of the system for the handling of tubular elements made according to the present invention.
Figure 40:
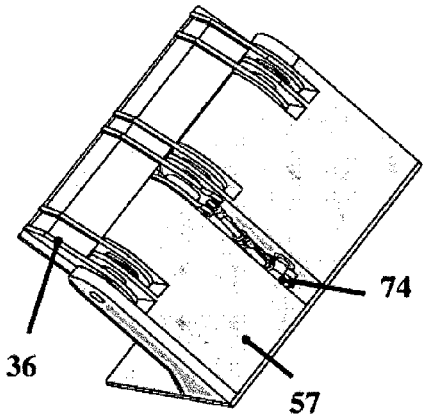
FIG. 40 schematically represents a perspective view showing the control mechanism of the movement of the tooth of the lifting device of FIG. 38.
Figure 39:
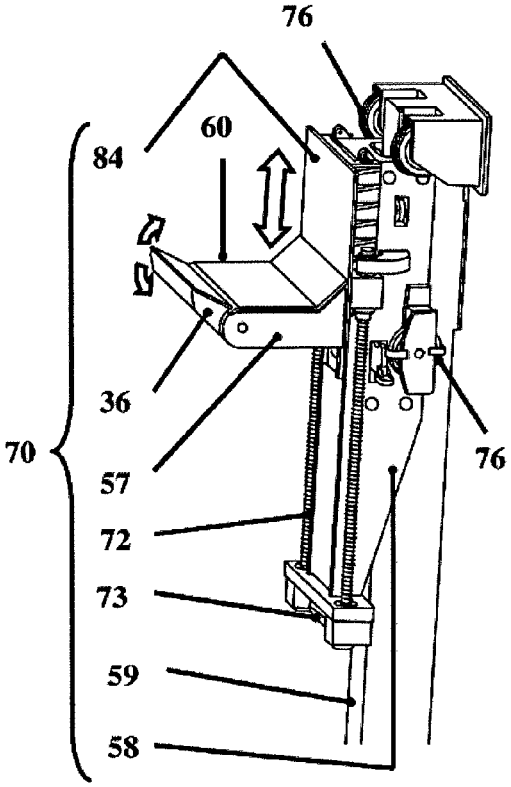
FIG. 39 schematically represents a perspective view of the lifting device of FIG. 38 according to a different point of view.

Even more preferably (FIG. 38, FIG. 39, FIG. 40), each cradle (57) is mounted on a respective second body (84) which in its turn is vertically sliding on the first body (58). The first body (58) can slide vertically in lifting and in lowering along the stanchion (59) that guides its movement and on which the driving means of the first body (58) supporting the cradles (57) are installed. For example the driving means of the first body (58) can be made in the form of a motor (not shown) that, by means of a cable (not shown) and second pulleys (76), carries out the lifting and lowering movement of the first body (58) along the stanchion (59). The movement of the second body (84) is of the vertical type in the same way as that of the first body (58) and allows to obtain a prolongation of the movement of the cradles (57) obtaining a movement stroke greater than the one that would be obtainable with the stanchion (59) only. For example the second body (58) can be (FIG. 38) vertically mobile by means of a worm screw system in which an actuator (73) controls by means of a pair of shafts (75) the vertical stroke of the second body (58) along the screws (72). In this way, advantageously, a lowering and lifting movement of the cradles (57) is enabled by the interaction of the lifting device (4) with:

- the movement device (5) in correspondence (FIG. 22) with the lowered position of the second body (84) to manage the transfer phases of the tubular elements from the movement device (5) to the lifting device (4) or vice versa;
- the tilter device (65) in correspondence (FIG. 29) with the lifted position of the second body (84) to manage the transfer phases of the tubular elements from the lifting device (4) to the tilter device (65) or vice versa.

The movement of the tooth (36) occurs (FIG. 40) by means of an electrical or hydraulic drive (74), preferably in the form of a piston that exerts a pushing or traction force on the tooth (36) with respect to the cradle (57) on which the tooth (36) itself is hinged.

Finally, the system interfaces with a tilter device (65), made up of two rotating arms (78) provided with lifting pins, suitable to enter the main hole (10) of the tubular element (6), in the same way as what is described with reference to the engagement means (29, 30) of the movement device (5).

Figure 25:
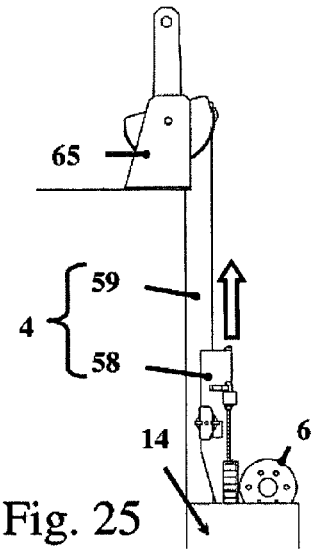
FIG. 25, FIG. 26, FIG. 27, FIG. 28, FIG. 29, FIG. 30 schematically show following transfer phases of the tubular elements between devices of the movement system for tubular elements made in accordance with the present invention outside a hold.
Figure 26:
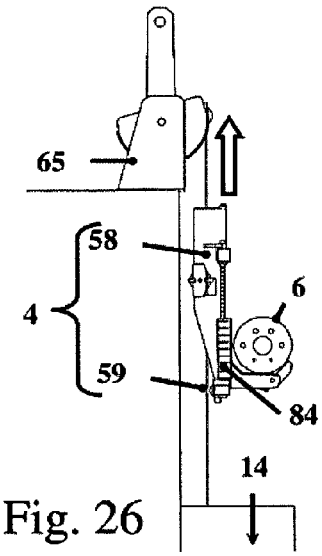
Figure 27:
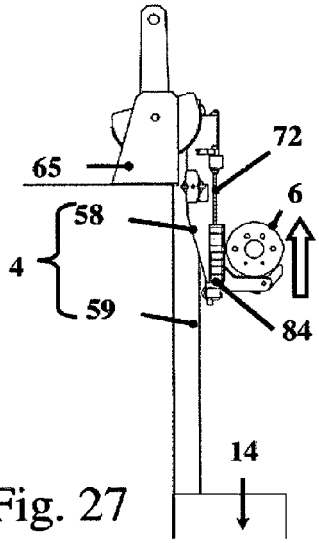
Figure 28:
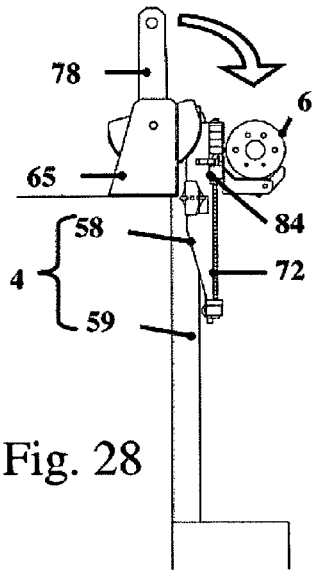
Figure 30:
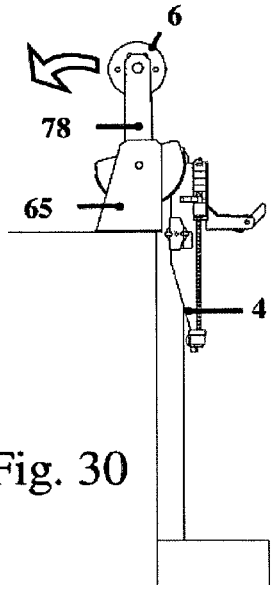
Figure 37:
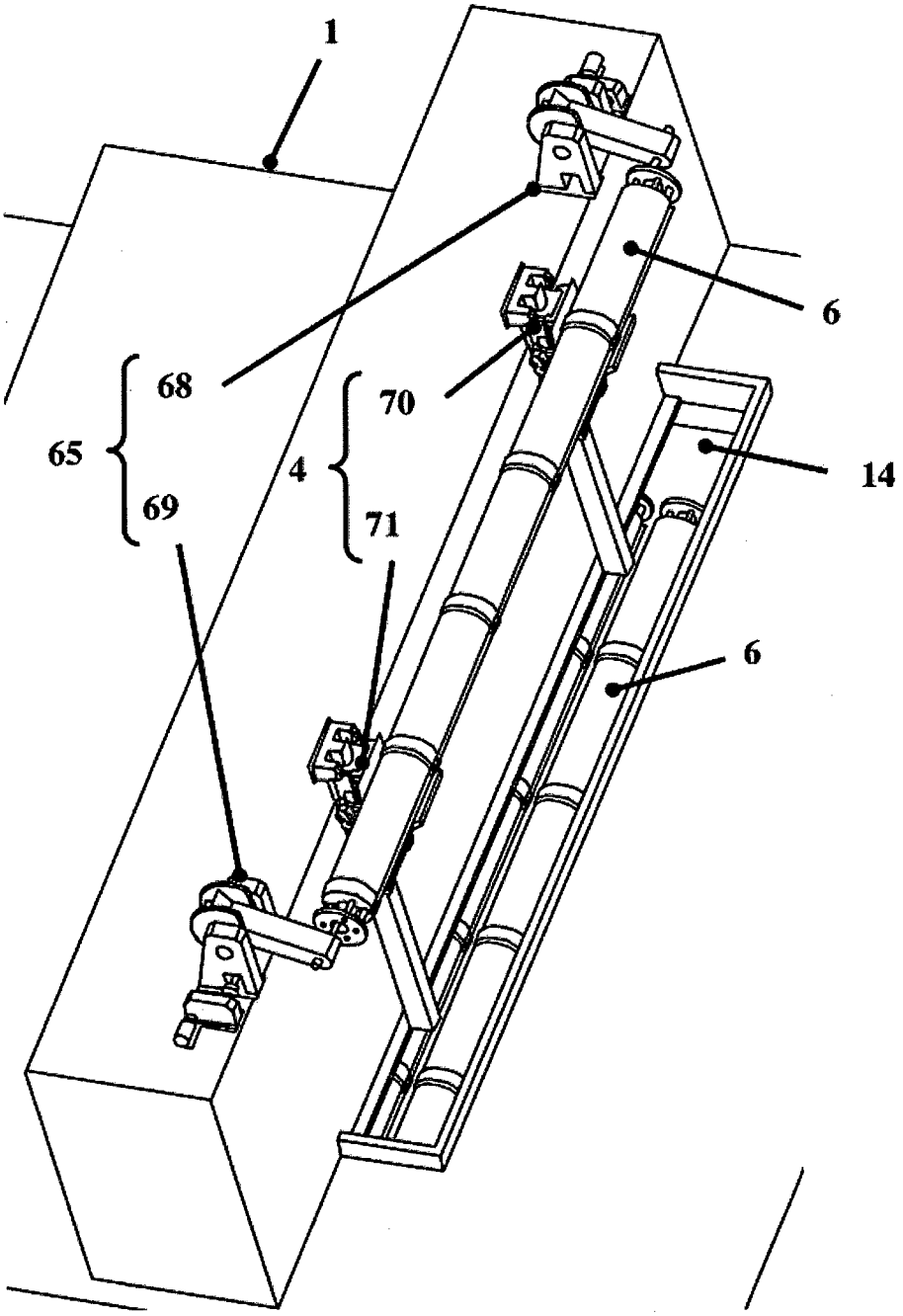
FIG. 37 schematically represents a perspective view showing the reciprocal position of the lifting device and tilter device of FIG. 36 following the loading of a tubular element for its movement.
Figure 41:
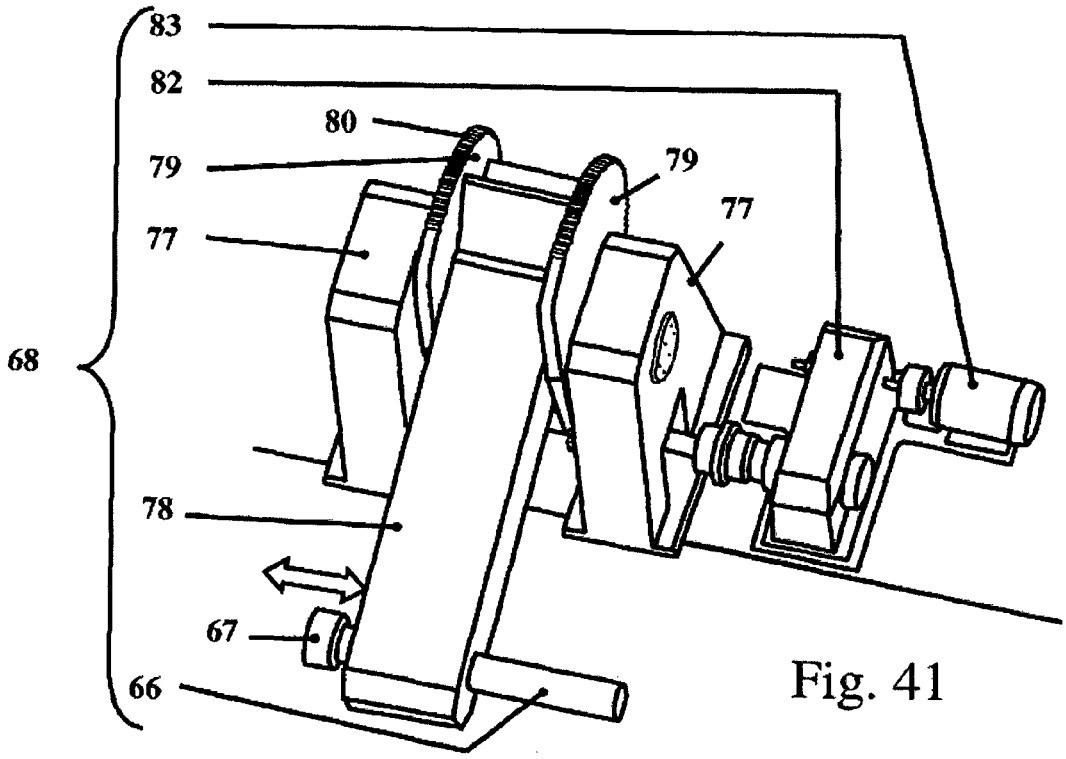
FIG. 41 schematically represents a perspective view of an embodiment of the tilter device of the system for the handling of tubular elements made according to the present invention.
Figure 42:
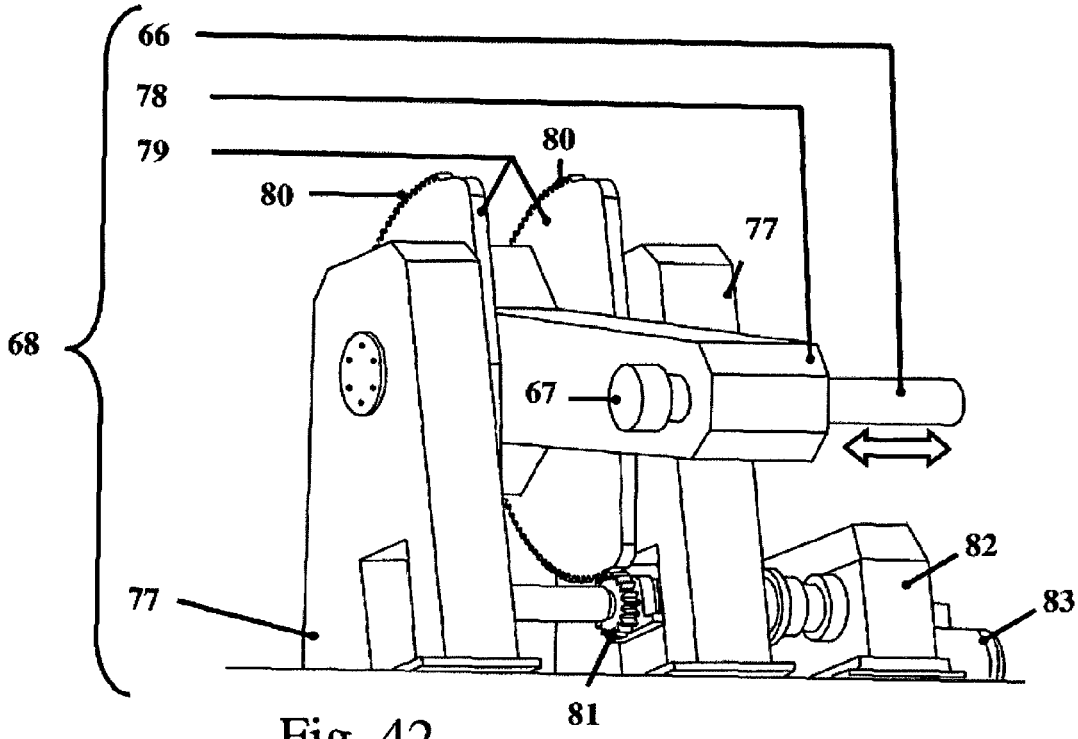
FIG. 42 schematically represents a perspective view of the tilter device of FIG. 41 according to a different point of view.
Figure 43:
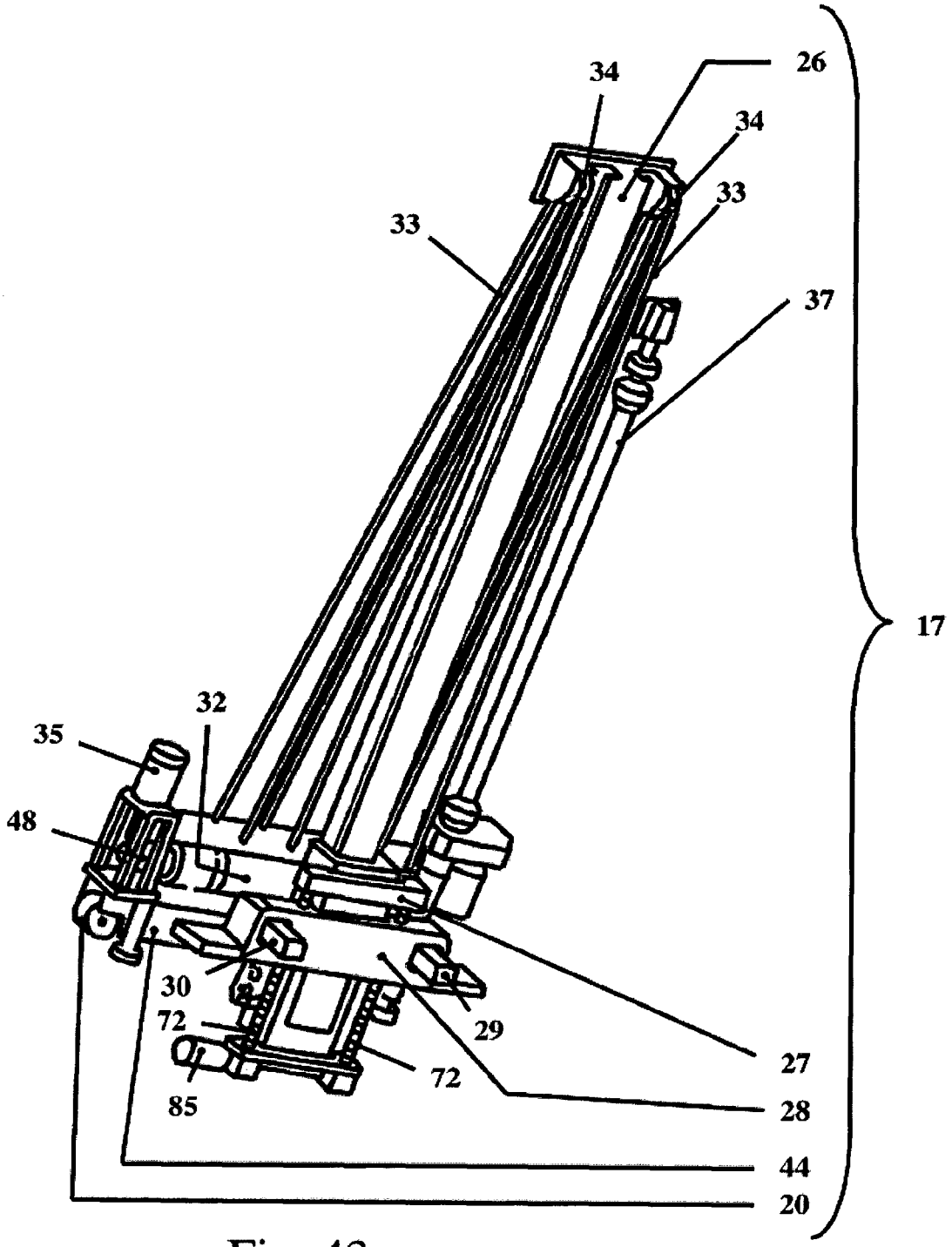
FIG. 43 schematically represents a perspective view of a different embodiment of the trolley of the movement device for tubular elements made in accordance with the present invention.
Figure 47:
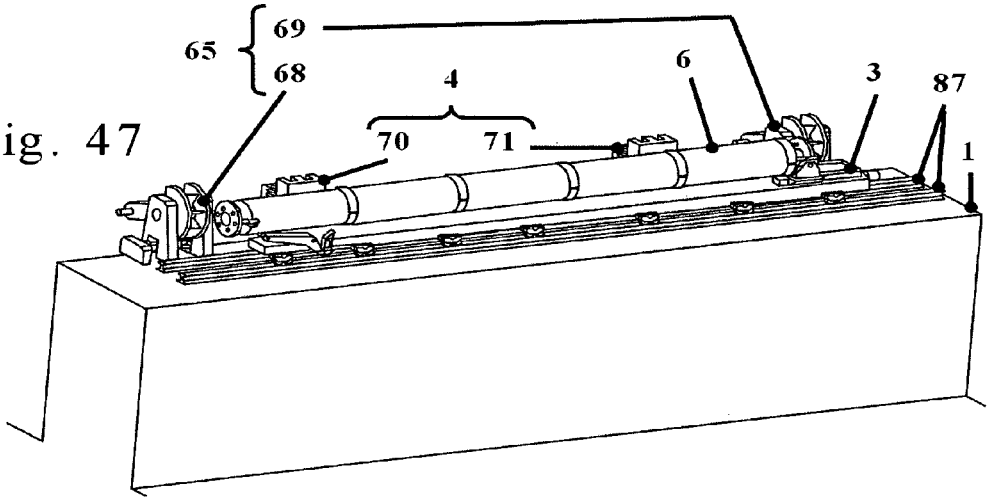
FIG. 47 schematically represents a perspective view showing the final phase of laying of the tubular element onto a transfer device.
Figure 48:
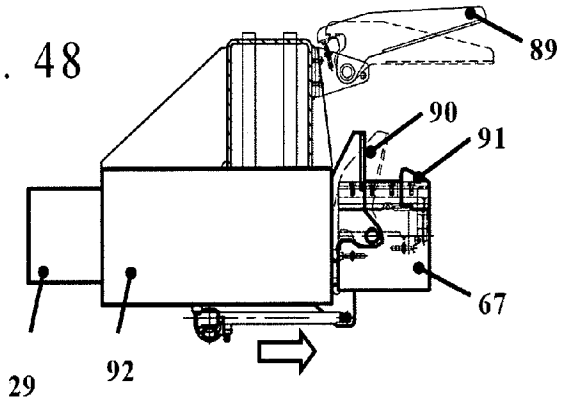
FIG. 48 represents an embodiment of the retractable insertion pin in which the insertion pin is shown in a withdrawn position.
Figure 49:
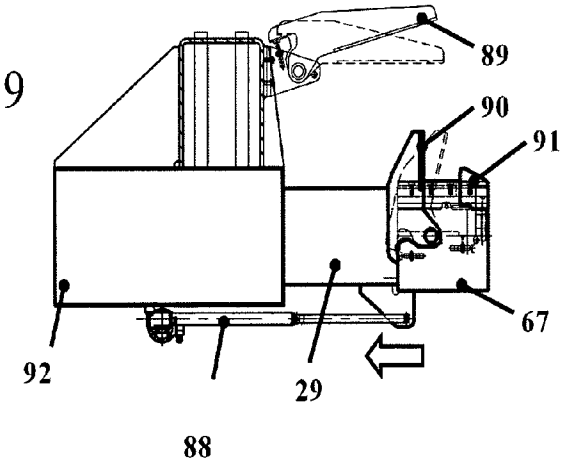
FIG. 49 represents an embodiment of the retractable insertion pin in which the insertion pin is shown in an extracted position.

In practice the tilter device (65) is made up of a pair of components of which a first component (68) and a second component (69) which are reciprocally aligned (FIG. 36, FIG. 37) according to a direction corresponding to the width of the tubular element (6) to be moved. The first component (68) and the second component (69) are spaced from each other by a distance greater than the width of the tubular element (6). The first component (68) and the second component (69) comprise (FIG. 41, FIG. 42) each a pair of supporting elements (77) which support a rotating arm (78) by hinging. The centres of rotation around which the two arms (78) are rotating are reciprocally aligned (FIG. 36, FIG. 37) according to a direction corresponding to the width of the tubular element (6) to be moved. That is to say, the centre of rotation of the arm (78) of the first component is aligned with the centre of rotation of the arm (78) of the second component in such a way that the arms (78) perform a rotation along reciprocally parallel planes. The rotation of the arm (78) is controlled by means of a fourth motor (83) which by means of a third gear-reducing device (82) puts in rotation a pair of gears (81) arranged on a same motor shaft. Each gear acts on a corresponding toothed portion (80) present on operating wings (79) of the arm (78) that are integral with the arm itself. In practice one realizes a toothed coupling with a speed reduction function given by the different diameter of the gear (81) with respect to the size of the wing (79). Advantageously, the wing (79) is made in the form of a portion of circular plate, because the rotation that has to be made by the tilter device (65) is not made on an arc of 360 degrees but must follow only a stretch approximately of 180 degrees to take (FIG. 28, FIG. 29, FIG. 30) the tubular element (6) from the lifting device (4) to the following transfer device (3) or vice versa in case of loading of the hold. In practice the tubular element (6) is lifted from the hold (14) by means (FIG. 25, FIG. 26) of the lifting device (4) whose first body (58) slides vertically on the stanchion (59) and in which the possible second body (84) slides (FIG. 27, FIG. 28) on the worm screw means to extend the lifting and lowering movement of the cradle (57). At this point (FIG. 28, FIG. 29) the tilter device (65) is operated and the arm (78) is rotated in order to take the respective engagement means or third pin (66) in correspondence (FIG. 29, FIG. 37) with the grasp zone of the tubular element on the lifting device (4). Once the engagement means or third pins (66) of the arms (78) are both in an extracted position, that is to say, they are inserted in the hole (10) of the tubular element (6), the arm (78) is rotated (FIG. 30) to lift the tubular element (6) from the lifting device (4), which is thus free to go down into the hold again to take out another tubular element while the tilter device (65) lays (FIG. 47) the tubular element onto the transfer device (3).

The grasp of the tubular element (6) by the tilter device (65) occurs by means of engagement means in the form (FIG. 41, FIG. 42, FIG. 37) of a retractable third pin (66) placed in correspondence with the arm (78), the third pin (66) of the arm (78) of the first component (68) being movable in a coordinated way with the third pin (66) of the arm (78) of the second component (69):

- according to directions of engagement with the tubular element (6) that correspond to directions of reciprocal approach of the third pins (66) and
- according to directions of disengagement from said tubular element (6) that correspond to directions of reciprocal moving away of the third pins (66).

The reciprocal approach of the third pins (66) implies the insertion of the third pins (66) into the tubular element (6) from directions opposite to each other, locking the tubular element on the tilter device (65) which can then move in rotation the arms (78) to lay (FIG. 47) the tubular element (6) on the transfer device (3), which for example can carry out the transfer on rails (87) to another zone of the vessel (1). For example the transfer device (3) can be the transfer device of the risers usually indicated by the name of "catwalk" that carries out the transfer (FIG. 1) to a derrick (2).

The innovative system according to the present invention can advantageously manage in a completely automatic way the main phases of the operation of movement of the tubular elements (6) from the storage zone (14) to the laying zone (2) or vice versa from a loading zone or from a laying zone (2) to the storage zone (14). Contrary to the prior art systems which must necessarily be managed in a manual way by the operators, the system according to the present invention, preventing suspended load conditions, is able to carry out a completely guided and restrained movement of the tubular elements also allowing, therefore, for the automatic transfer of a tubular element from a device to the other, such as from the movement device (5) to the lifting device (4) or from the lifting device (4) to the tilter device or vice versa.

Advantageously the movement device (5) is made up of two trolleys, that is to say, a first trolley (17) and a second trolley (18) which are movable in a reciprocally coordinated and synchronized way during the movement phases of the tubular elements. However, being the two trolleys completely mechanically free because the synchronization occurs by means of an electronically controlled synchronization, it is also possible to control the first trolley (17) and the second trolley (18) independently of each other. Such operating mode is particularly useful during the inspection phases. In the prior art solutions it was necessary to provide a complex system of stairs and gangways as well, which allowed access to the stacks of tubular elements in order to be able to carry out an inspection of these for example during navigation or prior to their taking out. With the solution according to the present invention one completely eliminates the need for stairs and gangways as the first trolley (17) and the second trolley (18) are provided (FIG. 15, FIG. 16) with at least one protection basket (61) able to accommodate an operator who, by controlling the respective trolley, can inspect freely and rapidly the tubular elements reaching any position within the storage zone without having to move physically within the storage zone itself but always remaining within the basket (61) placed on the cursor (27) of the trolley (17, 18). Furthermore, being able to use the two trolleys in an independent way one can carry out the inspection simultaneously from opposite sides of the stack by means of two operators, a first operator on the first trolley (17) and a second operator on the second trolley (18).

Furthermore, one can also provide an automatic inspection system in which a control unit controls the movement of the baskets (61) placed on the cursors of the trolleys (17, 18) in order to guide the operators in the inspection operations in such a way that the operators verify, under the action of control of the control unit, the tubular elements (6) according to an inspection order that corresponds to the laying order of the tubular elements, in order to promptly highlight any problems and plan in advance possible solutions or changes to the programme of laying of the tubular elements (6).

Furthermore, the system according to the present invention also allows to completely automate the inspection phase as the cursor (27) of the trolley (17, 18) can be advantageously provided with visual detection or measurement means to perform operations of automatic supervision of the stored tubular elements (6). For example one can use video cameras or sensor means able to identify and detect in an automatic way the presence of any anomalies, signalling to an operator the need for an intervention or for a more accurate control. For example, following the detection of an anomaly, the system can display on a monitor an image of the tubular element (6) on which the anomaly was detected so that the operator can decide whether to catalogue this signal as a false alarm or as a real anomaly or can decide to send to the site an operator who will carry out an in-depth control to establish the cause of the problem and verify whether the tubular element (6) is actually damaged or if it is usable. Advantageously one will appreciate that in that case the operator who must carry out the control will not have the need to locate the tubular element in the stacks as the trolley (17, 18) itself will take the operator in correspondence with the position in which the tubular element to be inspected is.

As previously observed, the lifting device (4) is characterised by having the lower section of its cradles (57) configured according to a telescopic shape. This allows the cradles (57), sized to lift the tubular elements (6), to go down into the hold or into the storage zone (14). This particularity allows to eliminate the need for a further hold elevator to take the tubular elements out of the hold as is necessary in some prior art solutions. In this way, by eliminating a further device from the hold it is possible to obtain a further saving of space in height within the hold which can be advantageously exploited to house a greater number of tubular elements (6) or to reduce the size of the vessel (1), with evident great benefits in both cases. The particularity of the different engagement system of the tubular elements that for the movement device (5) is made up of the pins (29, 30) and for the lifting device (4) is made up of the cradles (57), allows for the transfer of the tubular elements between the two devices with the tubular element (6) never being left free to all advantage of the safety of the operation enabling a movement in an always guided and restrained condition of the tubular elements (6). The lifting device (4) can thus lift the tubular element (6) out of the hold taking it to the tilter device. The tilter device can then take out the tubular element (6) by an engagement system with telescopic pins similar to the engagement system with pins of the movement device (5) that has been previously described. The tilter device will lay the tubular element (6) onto the transfer device (3), which in the case of the specific application of the risers on a drilling vessel will be made up of the device usually called "catwalk". In a way absolutely similar to what has already been seen, the use of two different hooking systems of the tubular element (6) by the two devices involved, that is to say, the lifting device (4) and tilter device allows for a completely guided and restrained transfer of the tubular element in conditions of maximum control and safety both for the operators and for the tubular elements.

In the case of risers stored outside (FIG. 34, FIG. 35) the process is extremely simpler because normally one single machine is involved, which is made up of a bridge crane that, after taking the riser from its storage position, unloads it directly onto the "catwalk". However, this entails the need for a structure of the bridge crane sufficiently large and developed in height able to reach the whole area dedicated to storage and to lift the risers up to the level of the "catwalk". However, it is evident that it is possible to extend the use of all the devices according to the present invention also to this case with the advantages deriving from them, as previously explained, or a combination of only some of them there being no longer some restraints made up of the presence of the deck for the upper closing of the hold, or to use the movement device (5) only reducing to the minimum the number of machines involved in the operation.

In general the present invention is applicable in the movement of tubular elements (6) on vessels (1) that operate in offshore work conditions. The tubular elements can be risers in the case of drilling vessels or pipes in the case of pipe-laying vessels. For example the pipe-laying offshore means are means used to build and lay on the sea bed underwater ducts. These means need to move, during the operations, large quantities of pipes which make up the ducts to be laid on the sea or ocean bed. In this case, the element to be moved is no longer a composite pipe like the riser but they are real pipes with much variable diameter and lengths. Obviously in this case the movement needs change too: the aim is no longer to move the pipes from the hold to a "catwalk" but, in a completely analogous way, to enable their loading into the hold from the support ships dedicated to supply the means with new pipes, or to take out the pipes from the hold to position them on the welding line where are they are pre-assembled and then to draw them and take them onto the launch line where they are connected to the already launched section of pipes to be lowered onto the sea bed. In this case, too, the advantages deriving from the application of the present invention are evident.

One will also appreciate that the present invention advantageously provides a movement method for tubular elements (6) on a vessel (1) at least in correspondence with a storage zone (14) of the vessel (1) itself or from the storage zone (14) to a feeding zone (2) or vice versa, wherein the tubular element (6) is advantageously always moved in an essentially restrained condition preventing suspended load conditions. In particular the movement method includes movement phases of the tubular elements carried out by means of at least one pair of devices of a handling system (3, 4, 5, 65) of the tubular elements (6) and transfer phases of the tubular element (6) from a first device of said handling system (3, 4, 5, 65) to a second device of said handling system (3, 4, 5, 65). The transfer of the tubular element (6) from the first device to the second device of said handling system (3, 4, 5, 65) occurs by alternating different types of grasp and transfer means of the tubular element (6). In particular the transfer phases from the first device to the second device can comprise:

A) first transfer phases including:

a1) a grasp phase of the tubular element (6) by the first device (5, 65) by means of engagement means in the form of pins (29, 30, 66) that enter the tubular element (6) in correspondence with opposite ends (11, 12) of the tubular element (6);

a2) a movement phase of the tubular element (6) by the first device (5, 65) to a transfer position towards the second device (4, 3);

a3) a deposition phase onto supporting means of the tubular element (6) that are present on the second device (4, 3) and that are preferably made in the form of cradles (57) provided with deposition seats (60) for the tubular element (6);

a4) a release phase of the tubular element (6) by the pins (29, 30, 66);

B) second transfer phases including:

b1) a grasp phase of the tubular element (6) by the second device (5, 65) by means of the supporting means of the tubular element (6) that are present on the second device (4, 3) and that are preferably made in the form of cradles (57) provided with deposition seats (60) for the tubular element (6);

b2) a movement phase of the tubular element (6) by the second device (4, 3) to a transfer position towards the first device (5, 65);

b3) a grasp phase of the tubular element (6) by the first device (5, 65) by means of the engagement means in the form of pins (29, 30, 66) that enter the tubular element (6) in correspondence with opposite ends (11, 12) of the tubular element (6).

The description of the present invention has been made with reference to the enclosed figures in a preferred embodiment, but it is evident that many possible alterations, changes and variants will be immediately clear to those skilled in the art in the light of the previous description. Therefore, it should be underlined that the invention is not limited to the previous description, but it includes all alterations, changes and variants in accordance with the appended claims.

NOMENCLATURE USED

With reference to the identification numbers shown in the enclosed figures, the following nomenclature was used:

1. Vessel
2. Derrick or laying zone
3. Transfer device
4. Lifting device
5. Movement device
6. Tubular element
7. Vertical duct
8. Valve
9. Sea or ocean bed
10. Main hole
11. First end
12. Second end
13. Auxiliary line
14. Storage zone
15. Column
16. Deck
17. First trolley
18. Second trolley
19. First guide
20. First wheel
21. Second guide
22. Second wheel
23. Third guide
24. Third wheel
25. First wall or first supporting structure
26. Frame
27. Cursor
28. Elevation element
29. First pin
30. Second pin
31. Cursor driving means
32. Winch
33. Cable
34. First pulley
35. First motor
36. Tooth
37. Trolley driving means
38. Third motor
39. Transmission
40. Fourth guide
41. Fourth wheel
42. Disc
43. Brake
44. Base
45. Rack coupling
46. Case
47. Bearing
48. First gear-reducing device

49. First direction
50. Second direction
51. Air space
52. Stack
53. Retaining element
54. First side
55. Second side
56. Second gear-reducing device
57. Cradle
58. First body
59. Stanchion
60. Deposition seat
61. Basket
62. Second wall or second supporting structure
63. Control unit
64. Command unit
65. Tilter device
66. Third pin
67. Head
68. First component
69. Second component
70. First elevator
71. Second elevator
72. Screw
73. Actuator
74. Driving device
75. Shaft
76. Second pulley
77. Supporting element
78. Arm
79. Wing
80. Toothed portion
81. Gear
82. Third gear-reducing device
83. Fourth motor
84. Second body
85. Second motor
86. Compensator device
87. Track
88. Pin actuator
89. First sensor
90. Second sensor
91. Third sensor
92. Holder
d. Distance

The invention claimed is:

1. A handling system for handling a tubular element on a vessel in correspondence with a storage zone of the vessel and the storage zone to a feeding zone or from the feeding zone to the storage zone, the handling system comprising:

a deposition seat having at least one deposition cradle;

a lifting device adapted to lift or lower the tubular element between at least two positions, a first position of the at least two positions being a load position of the tubular element on said lifting device, a second position of at the at least two positions being an unload position of the tubular element from said lifting device, said first position being a position for transferring the tubular element to said lifting device within said deposition seat or a position for transferring the tubular element from said deposition seat towards another device of the handling system;

a tilter device interfaced and coordinated with said lifting device, said tilter device having arms adapted to tilt the tubular element between a support position within said deposition seat and a support position on a transfer device, said transfer device adapted to transfer the tubular element to a laying zone from the loading zone for the tubular element on the vessel, said tilter device having a first component and a second component which are reciprocally aligned according to a direction corresponding to a length of the tubular element and which are reciprocally spaced by a distance greater than a width of the tubular element, each of said first component and said second component comprising a pair of supporting elements which bear the arms and which arms are rotatable by a hinge, a center of rotation of the arm of said first component being aligned with a center of rotation of the arm of said second component, said arms carrying out a rotation along planes which are reciprocally parallel planes.

2. The handling system of claim 1, wherein the deposition cradle has a retractable tooth which is moveable between a first position in which said tooth is retracted so as to leave completely free access to said deposition seat so as to move the tubular element within said deposition seat and a second position in which said tooth is turned towards the deposition cradle so as to operate as a retainer for the tubular element within said deposition seat during lifting and lowering phases of the deposition cradle, wherein the movement of said tooth is caused by an electric or hydraulic driving device.

3. The handling system of claim 1, wherein the deposition cradle is mounted on a respective first body which is vertically slidable in a lifting movement and in a lowering movement along a stanchion which drives a movement of said first body, said stanchion having a driver for said first body and bearing the deposition cradle.

4. The handling system of claim 3, wherein the deposition cradle is mounted on said first body with an interposition of a second body, the deposition cradle being mounted on said second body which is in turn vertically slidable on said first body, said first body being slidable in a lifting movement and in a lowering movement along said stanchion, said second body being slidable in a lifting movement and in a lowering movement along said first body, the movement of said second body constituting a prolongation of a movement of the deposition cradle by said first body.

5. The handling system of claim 1, wherein the arm is controlled in rotation by a pair of gears which are placed on a common operating shaft, each gear of said pair of gears acting on a corresponding toothed portion which is present on operating wings of the arm or integral with the arm.

6. The handling system of claim 1, wherein said lifting device is interfaced and coordinated with a movement device for moving the tubular element in correspondence with the storage zone, the storage zone being a hold of the vessel, said lifting device being adapted to move the tubular element between the storage zone and a deck of the vessel, said lifting device adapted to lift or lower of the tubular elements between:

a first interface and transfer position of the tubular element between said movement device and said lifting device, said first interface and transfer position being located internally with respect to the hold of the vessel and a second interface and transfer position of the tubular element between said lifting device and another device of the handling system, said second interface and transfer position being located exterior of the hold of the vessel.

7. The handling system of claim 6, wherein said second interface and transfer position of the tubular element is an interface and transfer position of the tubular element between said lifting device and said tilter device.

8. The handling system of claim 6, wherein said movement device comprises at least two movable trolleys which are movable according to at least one first movement direction and which are reciprocally spaced by a distance, each of said at least two movable trolleys having at least one engagement device engaging with respective ends of the tubular element, said engagement of the respective ends corresponding to a taking out of the tubular element by said movement device for movement of the tubular element in correspondence with the storage zone.

9. The handling system of claim 8, wherein said at least two movable trolleys comprising:

a first trolley that is movable at least according to the first movement direction in correspondence with a first supporting structure which is parallel to said first movement direction; and a second trolley that is movable at least according to the first movement direction in correspondence with a second supporting structure which is parallel to the first movement direction, said second supporting structure being spaced by the distance with respect to said first supporting structure.

10. The handling system of claim 9, wherein each of said at least two movable trolleys has said engagement device, said engagement device of said first trolley being engageable with a first end of the ends of the tubular element and the engagement device of said second trolley being engageable with a second end of the tubular element which is an opposite end of the tubular element with respect to the first end.

11. The handling system of claim 9, wherein said first supporting structure and said second supporting structure comprising:

frame structures which are reciprocally opposite and parallel structures which are adapted to be placed on an upper part of a deck of the vessel, the deck of the vessel being the storage zone of the tubular element, said first supporting structure and second supporting structure being reciprocally opposite and parallel walls of a hold of the vessel, the hold of the vessel being the storage zone.

12. The handling system of claim 8, further comprising:

a command controller comprising at least one control unit which controls said movement device, the control unit controlling the movement of said at least two movable trolleys in a reciprocally coordinated and synchronized way with respect to each other according to a first control mode in which each of said at least two movable trolleys is controlled to carry out the same movement as the other one of said at least two movable trolleys, and at least one command unit which commands at least one of said at least two movable trolleys, the command unit controlling the movement of at least one of said at least two movable trolleys in an independent way with respect to the other trolley of said at least two movable trolleys according to a second control mode in which each of said at least two movable trolleys is controlled independent of the other of said at least two movable two trolleys to carry out maintenance or inspection operations of the tubular element within the storage zone.

13. The handling system of claim 8, wherein each of said at least two movable trolleys includes a frame that extends in a second direction which is an essentially vertical and an essentially orthogonal direction with respect to the first direction, said frame driving a movement of a cursor, said cursor being vertically movable along said frame and having at least one engagement device, said at least one engagement device being movable along the first direction by the movement of the trolley, said at least one engagement device being movable along the second direction by the movement of said cursor, the engagement device comprising a two-axled movement system for the movement of the tubular element in correspondence with the storage zone, each of said at least two movable trolleys having a cursor driver, said cursor driver carrying out the movement of said cursor along the second direction along said frame, said cursor driver having a first motor which transmits rotational motion to at least one winch which winds and unwinds a cable for the movement of said cursor along the second direction along said frame, said at least one winch comprising two winches each having cables with are controlled by said first motor by way of a first gear-reducing device, said two winches being controlled in a reciprocally synchronized manner by a single drive shaft which is connected to said first gear-reducing device, each of said two winches being structured to wind one of the cables.

14. The handling system of claim 13, wherein said first motor has a braking disc having corresponding brakes or said first motor having a pair of braking discs which are placed in correspondence with an output shaft of said first motor towards said at least one winch or in correspondence with an input shaft of said at least one winch.

15. The handling system of claim 13, wherein said cursor driver has said two winches and the cables each of which winds on one of said two winches, said cursor having a compensator device through which the cables pass, said compensator device inclining towards one side or towards an opposite side under the action of a difference in a traction force which is present between the cables, the inclination of said compensator device compensating for the difference in the traction force between the cables.

16. The handling system of claim 15, wherein said compensator device has rabbet elements that prevent inclinations of said compensator device beyond mechanically set limit values, said rabbet elements limiting the inclination of said compensator device to angel between +15° and −15° with respect to a balance position in which the cable apply an identical traction force.

17. The handling system of claim 8, wherein each of said at least two movable trolleys has an elevation element which is vertically movable between at least two positions, said engagement device being integral with said elevation element.

18. The handling system of claim 17, wherein said elevation element is vertically movable at least between the two positions by an endless screw movement system, a second motor acting on said endless screw system, said second motor controlling the movement of said elevation element for the lifting movement and the lowering movement along screws.

19. The handling system of claim 18, wherein said elevation element is installed on said cursor, said engagement device being vertically movable along the second direction by the movement of said cursor and being further vertically movable along said second direction between at least two positions along said cursor by movement of said elevation element.

20. The handling system of claim 19, wherein each of said at least two movable trolleys comprising:

first wheels which rest on a first guide which is parallel to the first direction, said first wheels driving the sliding of the trolley along the first direction and discharging on said first guide a weight of the respective trolley and of the tubular element handled by said at least two movable trolleys; and opposite pairs of second wheels whose rotational plane is placed on an essentially horizontal plane, said opposite pairs of second wheels coupling in correspondence to opposite sides of a second guide in the form of a rail which is tightened in an intermediate position between said opposite pairs of second wheels.

21. The handling system of claim 20, wherein said opposite pairs of said second wheels are placed along said frame at a first position along said frame which is a spaced and lowered position with respect to a second position along said frame which is an upper position with respect to said first position.

22. The handling system of claim 21, wherein each of said at least two movable trolleys includes a trolley driver, said trolley driver moving the trolley along the first direction.

23. The handling system of claim 22, wherein said trolley driver comprises a third motor which, by means of a second gear-reducing device, is coupled with two transmissions which respectively put in rotation fourth wheels, said fourth wheels comprising:

an upper fourth wheel which is supported by respective bearing elements, said upper fourth wheel being placed on a upper part of said frame along the second direction, said upper fourth wheel being a gear-wheel which couples with an upper fourth guide in a form of a rack; and a lower fourth wheel which is supported by respective bearing elements, said lower fourth wheel being placed on a lower part of said frame along the second direction, said lower fourth wheel being a gear-wheel which couples with a lower fourth guide in a form of a rack.

24. The handling system of claim 22, wherein said transmission are cardan shafts which by said second gear-reducing device receive a motion from said third motor being therefore reciprocally synchronized in order to control the movement of the trolley by the fourth guides.

25. The handling system of claim 8, wherein said one engagement device is at least one retractable pin which is moveable between at least two positions in which a first position is a withdrawn position which is a non-engagement position with the tubular element and a second position which is an extracted position which is an engagement position in which said pin is inserted within a hole of the tubular element.

26. The handling system of claim 25, wherein said engagement device is a pair of said retractable pins, said retractable pins being retractable and extractable between said first non-engagement withdrawn position and said engagement extracted position independent of each other.

27. The handling system of claim 26, wherein said pair of retractable pins comprises a first pin and a second pin which are reciprocally spaced by a distance greater than a section of the tubular element.

28. The handling system of claim 27, wherein a grasp action of the tubular element by a tilter device occurs by an engagement device in the form of a third retractable pin which is placed in correspondence with the arm, the third pin of the arm of the first component being movable in a coordinated way with the third pin of the arm of the second component according to an engagement direction with the tubular element which correspond to reciprocal approaching directions of said third retractable pin and according to the disengagement directions from the tubular element which correspond to reciprocal moving apart directions of said third retractable pins, the reciprocal approach of said retractable pin involving and insertion of said third retractable pin within the tubular element from directions which are reciprocally opposite directions with respect to each other.

29. The handling system of claim 25, wherein the retractable pin has an essentially quadrangular-shaped section with connection radii which essentially correspond to an internal radius of the tubular element, at least one contact portion of said essentially quadrangular-shaped section being covered by a soft or friction material.

30. The handling system of claim 25, wherein said retractable pin is slidable between a position in which said retractable pin is at least partially retracted within a holder and an extracted position from said holder in which said retractable pin is engageable with the tubular element, said retractable pin being movable by a pin actuator which operates in extension and extraction between said retractable pin and said holder, said pin actuator being an electrical actuator or a hydraulic cylinder.

31. The handling system of claim 25, wherein the retractable pin has an interchangeable head which is an engagement element of said retractable pin with the tubular element.

32. The handling system of claim 1, wherein the handling system handles tubular elements that are risers of drilling plants.

33. The handling system of claim 1, wherein the handling system is a handling system for tubular elements in the form of pipes to be laid on a sea or ocean bed so as to be connected to form an underwater duct.

34. A vessel that transported and lays tubular elements having the handling system of claim 1.

35. A vessel being selected from the group consisting of a drillship, a semisubmersible drilling rig, the vessel having the handling system of claim 1.

36. A pipe-laying ship having the handling system of claim 1.

* * * * *